US006978696B2

(12) United States Patent
Yu

(10) Patent No.: US 6,978,696 B2
(45) Date of Patent: Dec. 27, 2005

(54) CORKSCREW

(76) Inventor: Sung Il Yu, 1-307, LifeVilla, 639, Naeson 2-dong, Uiwang-si, Gyeonggi-do 437-082 (KR)

( * ) Notice: Subject to any disclaimer, the term of this patent is extended or adjusted under 35 U.S.C. 154(b) by 16 days.

(21) Appl. No.: 10/484,389

(22) PCT Filed: Jul. 26, 2002

(86) PCT No.: PCT/KR02/01404

§ 371 (c)(1),
(2), (4) Date: Jan. 21, 2004

(87) PCT Pub. No.: WO03/011742

PCT Pub. Date: Feb. 13, 2003

(65) Prior Publication Data

US 2004/0231465 A1 Nov. 25, 2004

(30) Foreign Application Priority Data

Jul. 27, 2001 (KR) ..... 20-2001-22895

(51) Int. Cl.[7] ..... B25G 3/18
(52) U.S. Cl. ..... 81/3.29; 81/3.33; 81/3.37
(58) Field of Search ..... 81/3.29, 3.33, 81/3.37, 3.36, 3.47, 3.48, 29

(56) References Cited

FOREIGN PATENT DOCUMENTS

DK 19800719 A1 * 8/1999
FR 2639629 A1 * 6/1990

* cited by examiner

*Primary Examiner*—Lee D. Wilson
*Assistant Examiner*—Alvin J Grant
(74) *Attorney, Agent, or Firm*—Nixon Peabody LLP

(57) ABSTRACT

A corkscrew for easily removing a cork from a wine bottle in the manner wherein a holding screw fixedly inserted in the cork is raised, even by a weak force, by rotating a removal handle, which is spirally coupled to a conveying screw integrally extended in a line from the holding screw, and which is rotatably engaged with a cylindrical support body placed over a mouth of the bottle.

14 Claims, 22 Drawing Sheets

CORKSCREW

BACKGROUND OF THE INVENTION

1. Field of the Invention

The present invention relates to a corkscrew for easily uncorking a corked wine bottle by removing a cork from the bottle with the use of gentle forces, and more particularly to a multifunctional corkscrew in combination with a corkscrew, a foil cutter, and a crown cap opener and/or a candlestick.

2. Description of the Prior Art

In general, the bottleneck of a wine bottle is covered by a cork, which is deeply inserted in the bottleneck, and cannot be easily removed. For this reason, so-called corkscrews are used to remove corks from wine bottles.

One of the corkscrews already known in the prior art typically has a spiral-shaped metal rod and a handle. To remove a cork by using the corkscrew, a user places a pointed end of the spiral-shaped metal rod on a surface of the cork while grabbing a wine bottle by one hand and rotates the handle by the other hand until the spiral-shaped metal rod is appropriately inserted in the cork. As the spiral-shaped metal rod is fixedly inserted in the cork, it is not easy to remove the cork from the bottleneck unless the user uses a strong force to pull the handle. Therefore, it is not suitable for a certain group of users, such as women or the aged, to use the corkscrew because the use of great forces is required for the removal of the cork.

Another example is a corkscrew having a long spiral-shape screw. A cork is removed in the manner wherein the screw penetrates the cork by a continuous rotational pressure and the cork is thereby moved upwardly along the screw. However, this kind of corkscrew has a problem in that, during the removal operation, fine pieces of the cork fall in the wine bottle and the wine is thereby contaminated.

A third example is a corkscrew which removes a cork by leverage. That is, as a screw is descended, levers are moved upwardly. When the levers are pressed downwardly, the cork is thereby removed. This type of corkscrew is inconvenient to use because the levers catch the user's hand that rotates the screw. Further, inserting the screw along the center axis of the cork may not be easy and the cork can be damaged when the screw is not properly spirally inserted into the center of the cork.

The conventional corkscrews, which remove the cork by pulling the handle or by pressing the levers, are neither convenient nor safe to use. Also, those kinds of corkscrews are not suitable for women or the aged because a strong force for pulling the handle is required to remove the cork. Further, wine is apt to contamination due to the broken pieces of the cork that come off when the screw penetrates the cork for the removal of the cork.

BRIEF DESCRIPTION OF THE INVENTION

Accordingly, a first object of the present invention is to provide a corkscrew for easily removing a cork from a wine bottle in the manner wherein a holding screw fixedly inserted into the cork is raised, even by a weak force, by rotating a removal handle which is spirally coupled to a conveying screw integrally extended in an axial line from the holding screw and which is rotatably engaged with a cylindrical support body placed over the mouth of the bottle.

A second object of the present invention is to provide a corkscrew further having a foil cutter for cutting a foil which wraps a cork in a bottle mouth before the cork is removed.

A third object of the present invention is to provide a corkscrew further having a structure, formed on a push-rotation handle, for carrying out the function of opening general crown cap bottles.

In order to accomplish the above objects, there is provided a corkscrew for removing a cork which covers a bottle mouth of a wine bottle from the bottle mouth, comprising: a support body placed over said bottle mouth; a removal handle rotatably engaged with said support body and having a coupling hole, of which the center portion has a female spiral; a conveying screw, coupled to said coupling hole of said removal handle, for forwardly moving with rotation along said female spiral by a rotational force applied and for moving backwardly without rotation by a rotation of said removal handle; a holding screw, aligned with and coupled to, as a single body, a front end of said conveying screw, for penetrating into said cork by the forward rotational movement of said conveying screw and for removing said cork from said wine bottle by the backward movement, without rotation, of said conveying screw; and a push-rotation handle, mounted on an upper portion of said conveying screw, for applying said rotational force to said conveying screw.

There is provided a corkscrew for removing a cork which covers a bottle mouth of a wine bottle, comprising: a casing type support body, placed over said bottle mouth and formed with, at an internal wall of the support body, at least one internal incline portion protruded in the center direction; a removal handle having a cylindrical body formed with a female spiral at the internal wall and a wing radially-bias and extended from an external wall of said cylindrical body, said wing being rotatably engaged with said support body; a conveying screw, spirally coupled to said cylindrical body of said removal handle, for forwardly moving with rotation along said female spiral by a rotational force applied and for moving backwardly, without rotation, by the rotation of said removal handle; a holding screw, aligned with and coupled to, as a single body, a front end of said conveying screw, for penetrating into said cork by the forward movement, with rotation, of said conveying screw and for removing said cork from said wine bottle by the backward movement, without rotation, of said conveying screw; a push-rotation handle, mounted on one end of said conveying screw, for inserting with rotation said conveying screw and said holding screw into said cork; and a cutter-installed casing, vertically movably mounted in a casing-shaped space defined by said removal handle and said support body, having the structure that an upper portion of the cutter-installed casing is vertically divided into at least two dividing portions, at least one foil cutter is installed at inside of said dividing portions, a surface of said dividing portions has at least one external incline portion, so that, in accordance with which said bottle mouth of said wine bottle is inserted in a predetermined depth by an external force, said bottle mouth of said wine bottle is pushed into said casing-shaped space, said external incline portion is pressed toward the center by said internal incline portion of said support body, and said foil cutter is pressed on a foil surface of a side of said bottle mouth of said wine bottle.

Further, there is provided a corkscrew for removing a cork which covers a bottle mouth of a wine bottle, comprising: a support body, the upper portion of said support body being vertically divided into at least two dividing portions so as to be elastically expandable when said bottle mouth of said wine bottle is inserted, at least one cutter mounted on at least one internal wall of said dividing portions so as to cut a foil by a rotational action and by pressing on said foil, and the lower center portion of said support body having a coupling hole on which a female spiral is provided; a conveying screw, spirally coupled to said coupling hole, for forwardly and backwardly moving by rotation along said female spiral by a rotational force applied; a holding screw, aligned with and coupled to, as a single body, in a front end of said conveying screw, for penetrating into said cork by the forward movement, with rotation, of said conveying screw and for removing said cork from said wine bottle by the backward movement, with rotation, along said female spiral, of said conveying screw while rotating by a rotational force of said wine bottle with the cork being held; and a push-rotation handle, mounted on one end of said conveying screw, for rotationally inserting said holding screw into said cork.

BRIEF DESCRIPTION OF DRAWINGS

The above objects and other advantages of the present invention will become more apparent by describing in detail preferred embodiments thereof with reference to the attached drawings, in which.

DETAILED DESCRIPTION OF THE INVENTION

Hereinafter, the preferred embodiments of the present invention will be explained in detail with reference to the accompanying drawings.

Figure 1A:
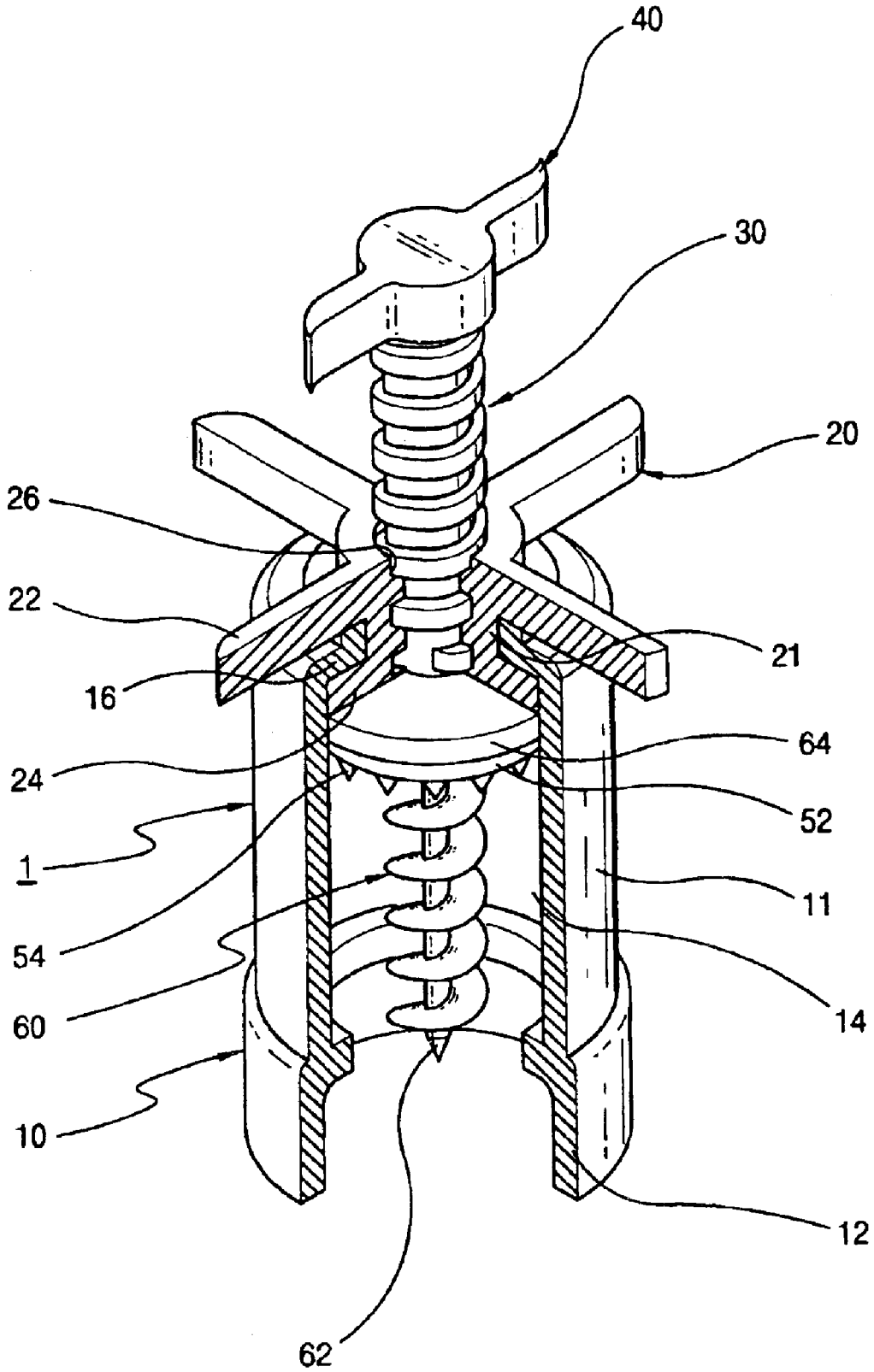
FIGS. 1A and 1B are, respectively, a perspective view of, and a partial sectional view of, a first embodiment of a corkscrew according to the present invention.
Figure 1B:
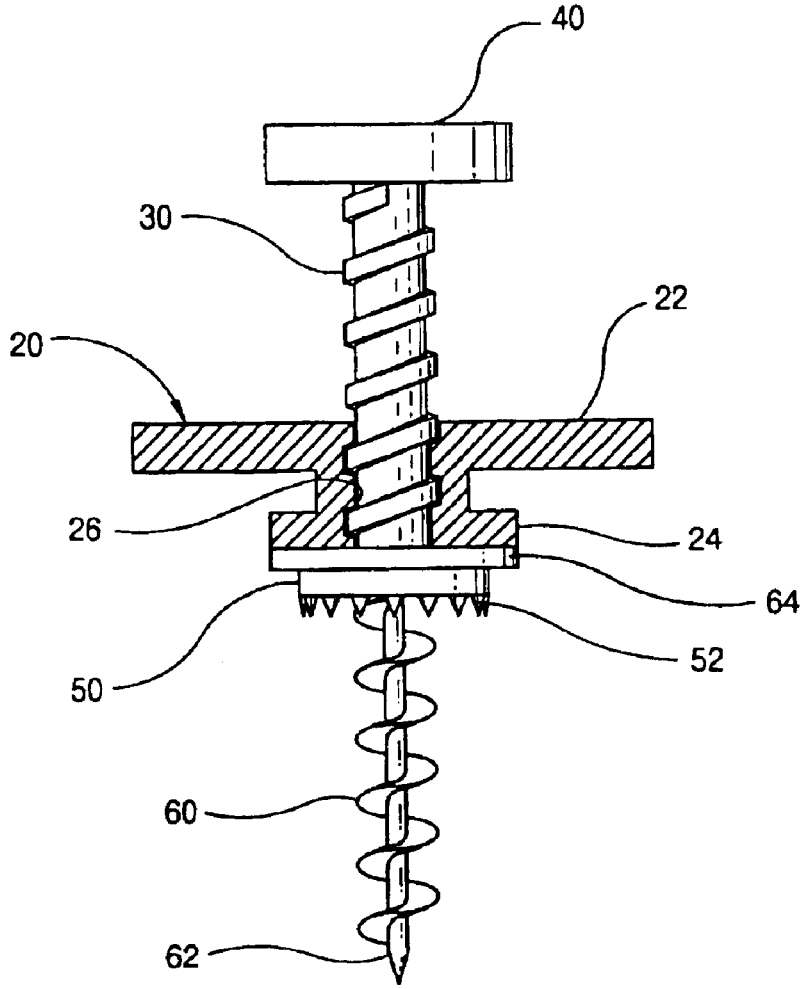
Figure 2:
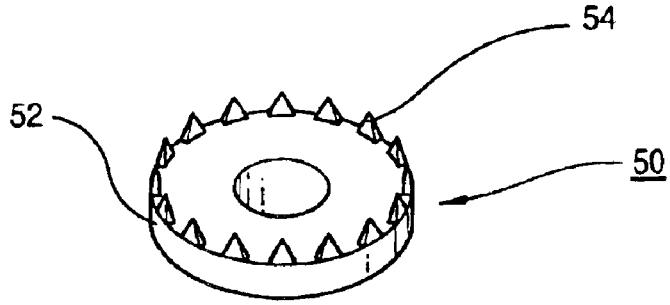
FIG. 2 is a perspective view illustrating that a disc-shaped cutting plate shown in FIG. 1A is turned upside down.

FIGS. 1A and 1B are, respectively, a perspective view of, and a partial sectional view of, one embodiment of a corkscrew according to the present invention. FIG. 2 is a perspective view illustrating a disc-shaped cutting plate, as previously shown in FIG. 1A, that is turned upside down.

As shown, a corkscrew 1 according to the present invention has a cylindrical support body 10 which is inserted by a bottle mouth of a bottle (not shown) to support and immovably hold the corkscrew 1 over the bottle. The inner space of the support body 10 is divided by a bottle catching portion 13 into two spaces; a fore space of insertion-fixing portion 12 over which the bottle mouth is placed to immovably support the corkscrew and to allow a holding screw spirally inserted in the center of the cork, and a rear space 14 which has enough length necessary for removing the cork from the bottle. The bottle catching portion 13 has a role to limit insertion of the mouth of the bottle to the bottle catching position of itself. Also, an upper end of the cylindrical sidewall 11 of the support body 10 has a catching portion 16 in the form that is vertically folded and extended to the center in a predetermined length. Each of the insertion-fixing portion 12 and the bottle catching portion 13 has a diameter fit for the size of the bottle mouth. A plurality of bottle catching portions applicable to several sizes of bottle mouth may be provided.

The corkscrew 1 has a removal handle 20 which is rotatably coupled to the catching portion 16 of the support body 10. The removal handle 20 has a substantially cylindrical body 21, at least one grip portion 22 extended from an upper portion of the body 21 in the radius direction, and a coupling support portion 24 extended from a lower portion of said body 21 in the radial direction from a surface of a cylindrical internal wall of the support body 10. Further, the body 21 provides a coupling hole 26 wherein the internal surface thereof has a female spiral.

The catching portion 16 of the support body 10 is inserted between the grip portion 22 of the removal handle 20 and the coupling support portion 24. Accordingly, as the coupling support portion 24 has a structure that retained in place by the catching portion 16 of the support body 10, the removal handle 20 can be rotated without movement toward the axis direction. In a case that the catching portion 16 has a structure that its tip portion is vertically folded and is slightly extended in the axis direction, a friction between the grip portion 22 and the catching portion 16 is reduced to secure smooth rotation of the removal handle 20.

The corkscrew 1 also has a conveying screw 30 and a holding screw 60. Those two screws 30 and 60 form a single body and are disposed in the manner in which the holding screw 60 is disposed at the front of the conveying screw 30 along the same axial line. The conveying screw 30 can be made in the manner wherein a male spiral portion 34 is so formed along, and on the circumferential surface of, a cylindrical body 32 so as to be coupled to a female spiral portion 28 within the removal handle 20. Likewise, the holding screw 60 can be made such that a male spiral portion is formed along the circumferential surface of a center member of which the end is pointed, as illustrated in FIGS. 1A and 1B. A stopping member 64 for limiting the withdrawal of the conveying screw 30 from the removal handle 20 can be provided between the conveying screw 30 and the holding screw 60. The conveying screw 30 is inserted into the coupling hole 26 of the removal handle 20 and is coupled thereto, and the holding screw 60 exists in the internal space 14 of the support body 10. The upper end of the conveying screw 30 is coupled with the push-rotation handle 40 to let the user easily rotate the conveying screw 30. If the holding screw 60 and the conveying screw 30 are designed to have an identical pitch, they can advance at an identical distance per one rotation.

In general, a wine bottle is stopped by a cork and the bottle mouth of the bottle is wrapped in a foil. If the corkscrew 1 has the function of cutting the foil, it will be more convenient. For this purpose, the corkscrew 1 further has a foil cutter. As one embodiment of a foil cutter, FIG. 2 illustrates a foil cutter in the form of a disc-shaped cutting plate 50. The disc-shaped cutting plate has a disc-shaped body 52 and a plurality of cutting blades 54 spaced apart along the circumferential edge of one side of the disc-shaped body 52. The conveying screw 30 and the holding screw 60 are, as a single body, fixed on the rear side of, and on the front side of, the center of the disc-shaped body 52, respectively. Alternatively, when the blocking member 64 is provided, the disc-shaped body 52 is provided between the stopping member 64 and the holding screw 60 to form in a single body with them as shown in FIG. 1B. The cutting blades 54 are protruded in the same direction that the holding screw 60 is protruded. The disc-shaped cutting plate 50 exists in the internal space 14 of the support body 10.

Although FIGS. 1A and 1B illustrate the holding screw 60, of which the center member 62 along which a spiral screw is shaped, has a pointed end, it does not mean that the holding screw is limited to that type. As long as the holding screw 60 can be inserted into the cork while rotating, it is possible to make any modification to the shape of the holding screw. Likewise, the conveying screw 30 illustrated in FIGS. 1A and 1B has a spiral screw which is formed along the center member. However, any modification to the shape of the conveying screw can be made.

Figure 3A:
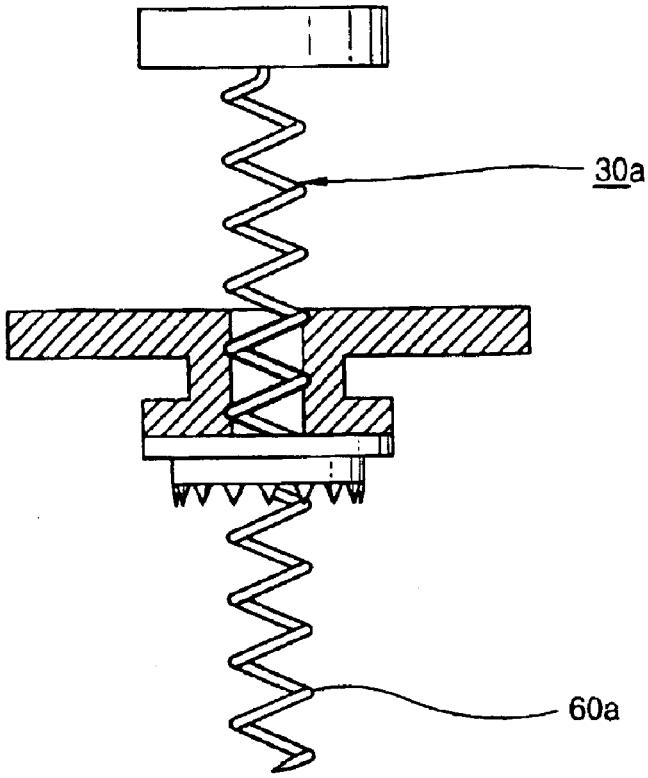
FIGS. 3A and 3B are partial sectional views illustrating other embodiments of a conveying screw of the corkscrew according to the present invention.
Figure 3B:
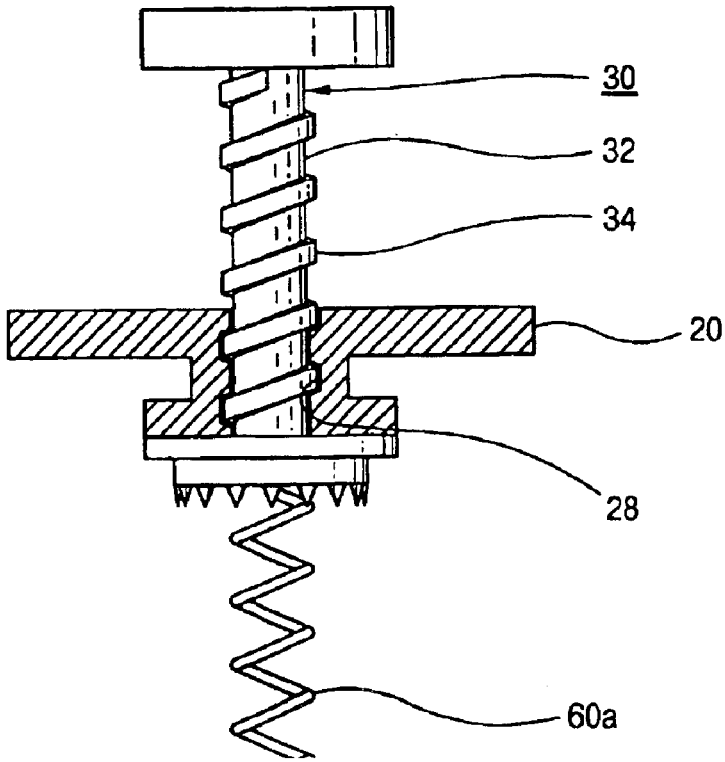

Such possible embodiments and modifications to the conveying screw 30 and the holding screw 60 are explained in more detail with reference to FIGS. 3A and 3B. FIGS. 3A and 3B are partial sectional views illustrating other embodiments of a conveying screw of the corkscrew according to the present invention.

As shown in FIG. 3A, the corkscrew can employ a spiral wire shaped conveying screw 30*a* as a substitute for conveying screw 30 shown in FIG. 1A. In that case, the spiral wire itself functions as a male spiral of the conveying screw 30*a*. Also, as illustrated in FIGS. 3A and 3B the corkscrew can also employ a spiral wire shaped holding screw 60*a* without the center member.

Figure 4A:
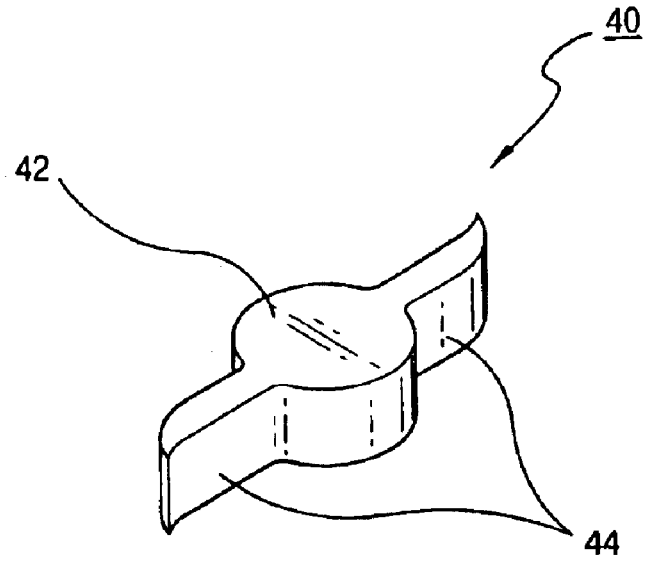
FIGS. 4A and 4B are perspective views illustrating embodiments of a push-rotation handle according to the present invention.
Figure 4B:
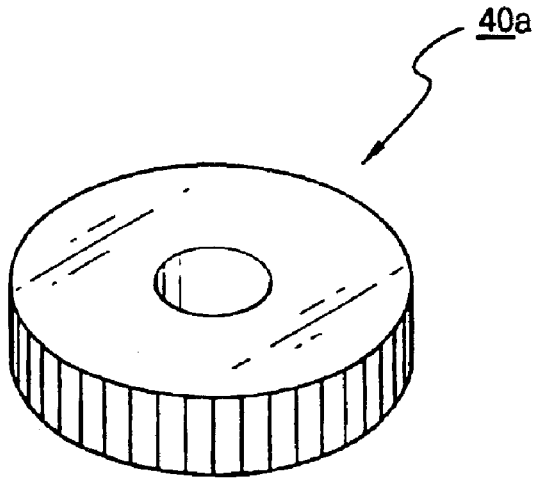

FIGS. 4A and 4B are perspective views illustrating embodiments of a push-rotation handle according to the present invention. The push-rotation handle 40 can be made, as shown in FIG. 4A, in such form that stick-shaped grip portions 44 are formed on both ends of a center portion 42 on which the conveying screw is fixed. As another embodiment, a disc type of push-rotation handle 40*a* as shown in FIG. 4B can be employed. For the push-rotation handle in disc form as shown in FIG. 4B, it is preferable that its side is embossed to avoid any slipping during the manual rotation. Of course, it is possible to modify the push-rotation handle to a triangular, rectangular, cross shape or to some other shapes.

Figure 5A:
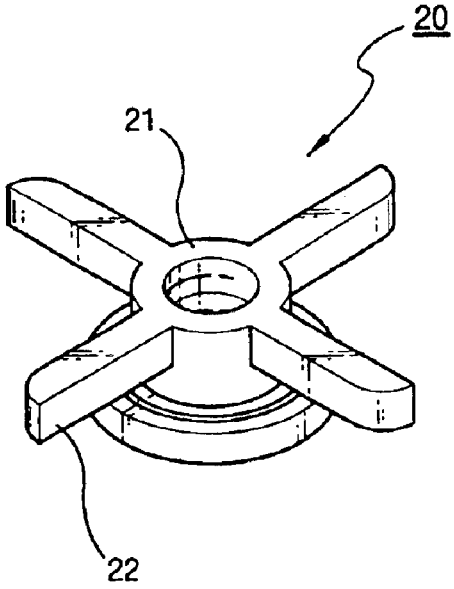
FIGS. 5A and 5B are perspective views illustrating embodiments of a removal handle according to the present invention.
Figure 5B:
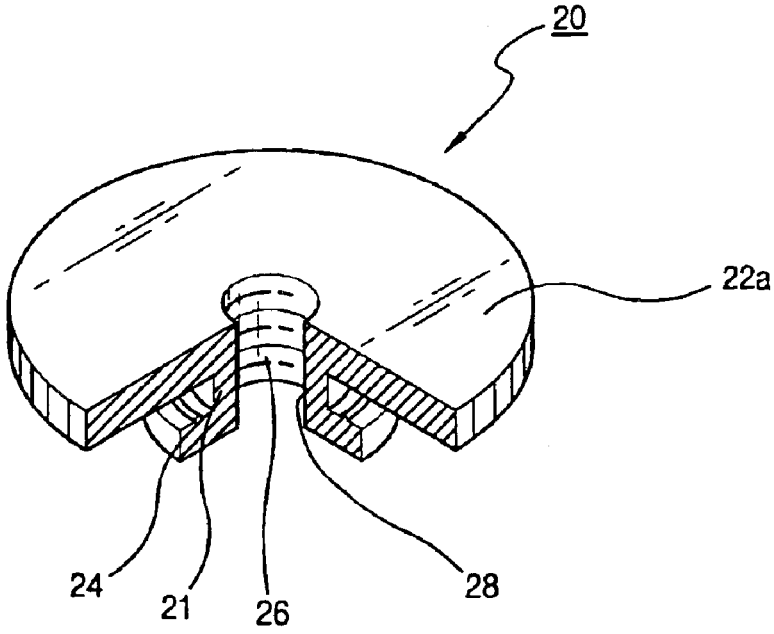

FIGS. 5A and 5B are perspective views illustrating embodiments of a removal handle according to the present invention. As described above, the removal handle 20 can have the stick-shaped grip portion 22 extended from the cylindrical body 21 as shown in FIG. 5A. For user's convenience, the stick-shaped grip portion 22 is formed into two or more, preferably four, as shown. As shown in FIG. 5B, another type of the removal handle 20 can also have a disc-shaped grip portion 22*a* of which the side is embossed. As described above, the cylindrical body 21 is disposed at the center of the removal handle 20 to provide a coupling hole 26 with the female spiral portion 28, to which the foregoing conveying screw 30 is spirally coupled. The coupling support portion 24 downwardly extended from the lower portion of the cylindrical body 21 is rotatably coupled by being retained by the catching portion 16 of the support body 10. To minimize a frictional force during the rotation, it is preferable that the catching portion 16 of the support body 10 and the coupling support portion 24 have a concave-convex portion (not shown) formed on either of a lower surface of the catching portion 16 and an upper surface of the coupling support portion 24. The concave-convex portion is on either of the surfaces which contact each other, and is disposed around the cylindrical body 21.

Of course, any modification of the removal handle 20 can be made within the spirit and scope of the present invention.

Figure 6A:
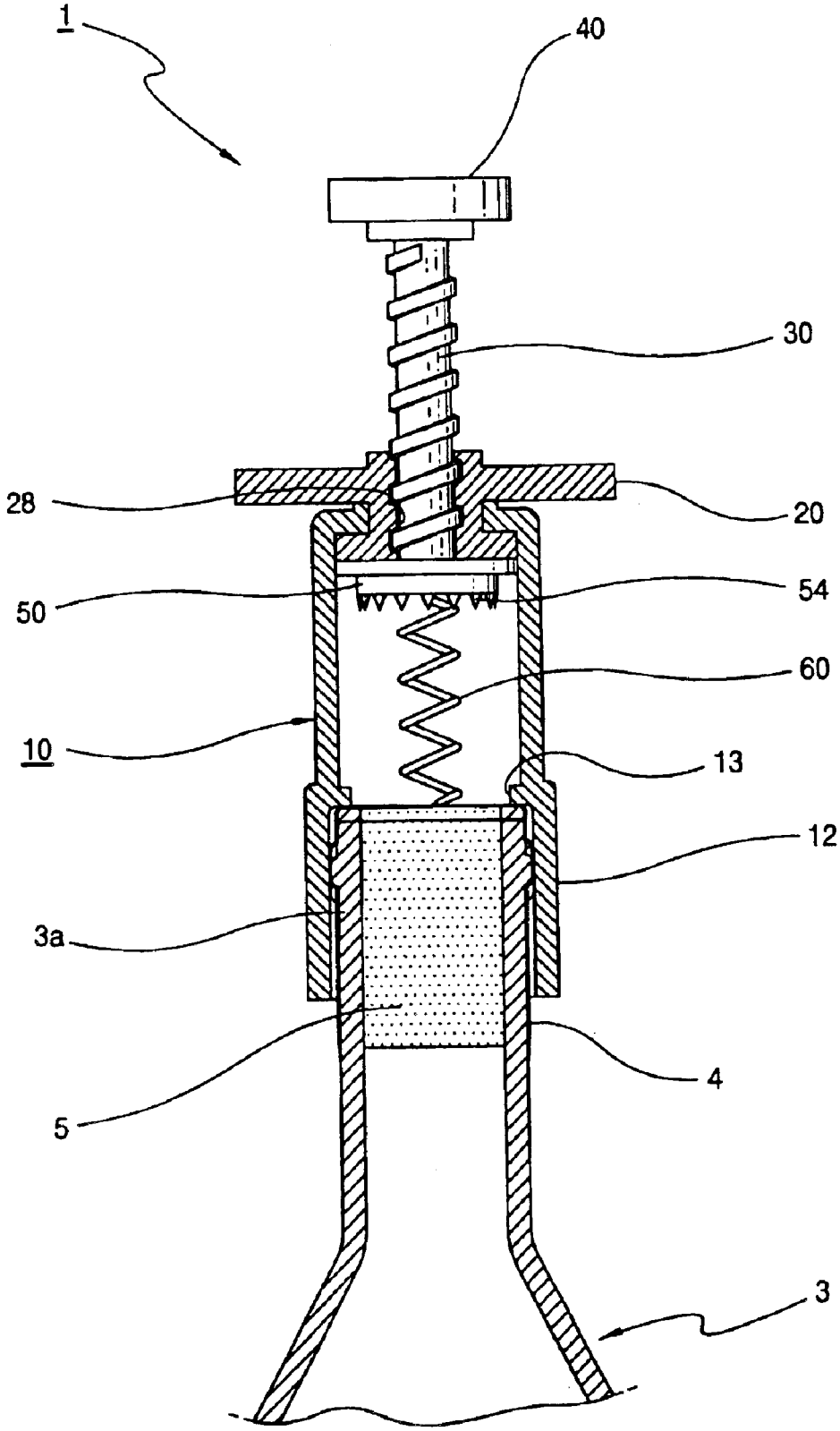
FIGS. 6A and 6B are sectional views showing the first embodiment of the present invention in use.
Figure 6B:
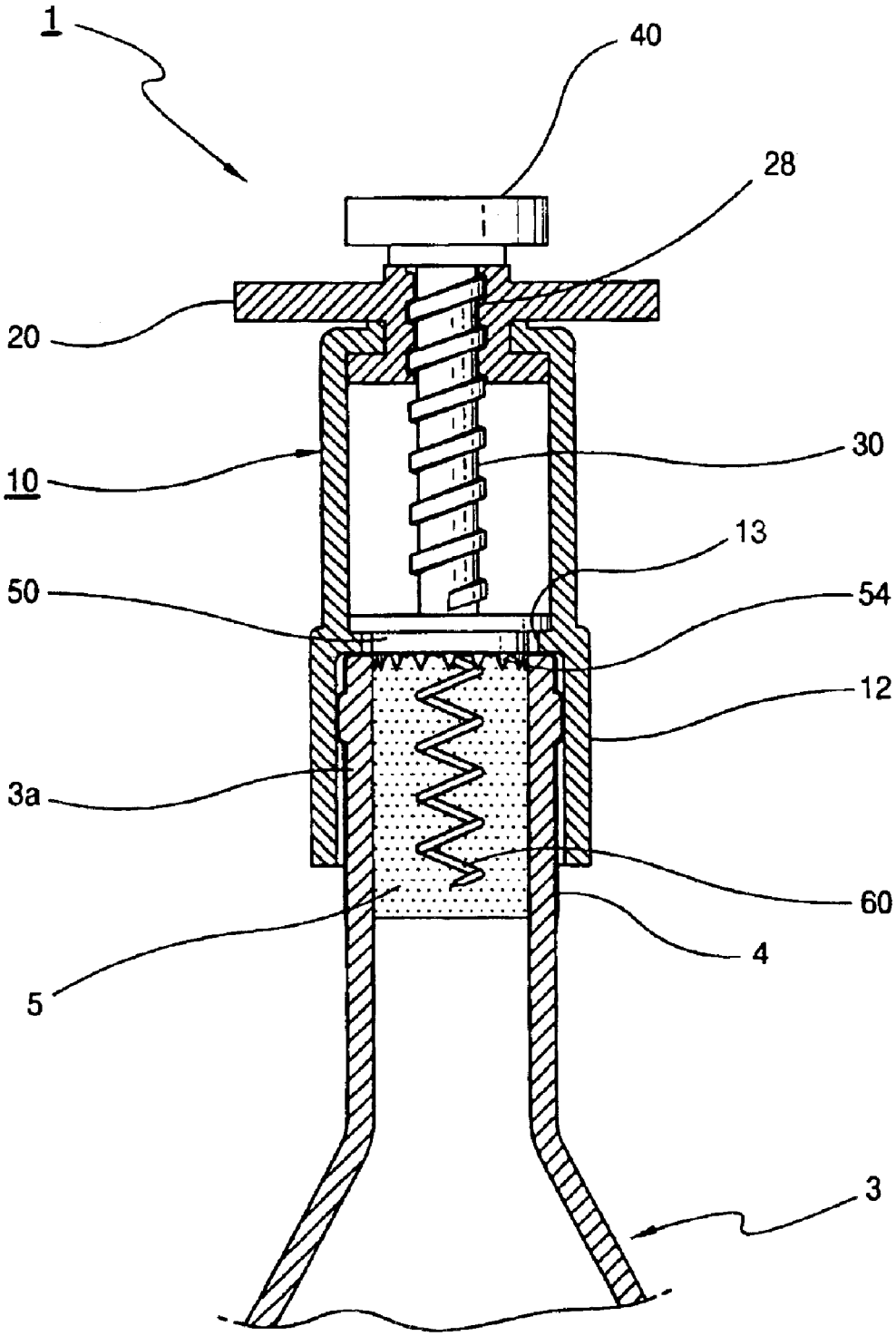

With reference to FIGS. 6A and 6B which are sectional views showing the present invention in use, the operation of the present invention is hereinafter explained in detail.

According to the coupling relationship between the support body 10 and the removal handle 20, when the user rotates, under the circumstance in which the removal handle 20 is immovably fixed and not to be rotated, the conveying screw 30 in the counterclockwise direction, the conveying screw 30 moves forwardly along the female spiral of the coupling hole 26 of the removal handle 20. When the conveying screw moves in the clockwise direction, the conveying screw 30 moves backwardly. Also, when the user rotates only the removal handle 20, as the removal handle 20 rotated is restrained not so as to move back-and-forth along the axis direction, the conveying screw 30 loaded on the female screw of the coupling hole 26 can be, without rotation, moved in the forward and backward directions. Accordingly, the cork can be removed from the bottle by means of the forward movement of the holding screw 60 to hold the cork by rotating the conveying screw 30 and then by means of the backward movement of the holding screw 60 to remove the cork from the bottle by rotating the removal handle 20. This mechanism is explained in more detail as follows.

To remove the cork 5 from the wine bottle 3, the support body 10 of the corkscrew 1 is immovably placed over the bottleneck (i.e., bottle mouth) 3*a* until an insertion-fixing portion 12 of the support body 10 is fitted on an exterior surface of the bottle mouth 3*a*, and a lower end portion of the holding screw 60 located within the support body 10 makes contact with an upper surface of the cork 5 as shown in FIG. 6A.

Under this state, the user grabs the removal handle 20 with one hand while rotating the push-rotation handle 40 with the other hand. Then, the push-rotation handle 40 is rotated and the conveying screw 30 connected to the push-rotation handle 40 is thereby rotated. The conveying screw 30 is downwardly moved, due to the rotation of the push-rotation handle 40, along the female spiral portion 28 of the removal handle 20; and, due to the downward movement, the disc-shaped cutting plate 50 and the holding screw 60, which are connected to the conveying screw 30, are thereby rotated as a single body while being moved downwardly. As shown in FIG. 6B, the holding screw 60 is continuously inserted with rotation into the cork 5. After the disc-shaped cutting plate 50 approaches closely to the cork 5, it is rotated on a surface of a foil which wraps the cork 5 so as to cut the foil circularly. As a result, the cork 5 is easily removed from the bottle. After making full and close contact with the cork 5, the disc-shaped cutting plate 50 restrains the holding screw from rotating.

With the holding screw 60 holding the cork 5 by insertion, the removal handle 20 is rotated in the same direction in which the foregoing push-rotation handle 40 is rotated so as to remove the cork 5 from the wine bottle 3. Then, due to rotation of the female spiral portion 28, the male spiral portion, spirally coupled to the female spiral portion 28, of the conveying screw 30 is pushed upwardly. In other words, when the removal handle 20, which is coupled to the support body 10 fitted on the bottle mouth 3*a*, is rotated and thereby upwardly pushes the conveying screw 30 spirally coupled to the removal handle 20, the conveying screw 30 comes to be vertically raised. Such removal operation of the cork 5 becomes possible because the force under which the conveying screw 30 is pushed upwardly by the female spiral portion of the removal handle 20 is greater than the frictional force between the cork 5 and an internal wall of the bottleneck 3*a*. As a result, the holding screw 60, which is formed with the conveying screw 30 as a single body, is moved upwardly while holding the cork 5. At that time, although the wine bottle 3 receives an ascending force due to the frictional force between the cork 5 and an internal wall of the bottleneck, the cork is removed, while the bottle mouth 3*a* is retained in place by the bottle catching portion 13 which may have a form of circular rim.

Figure 7:
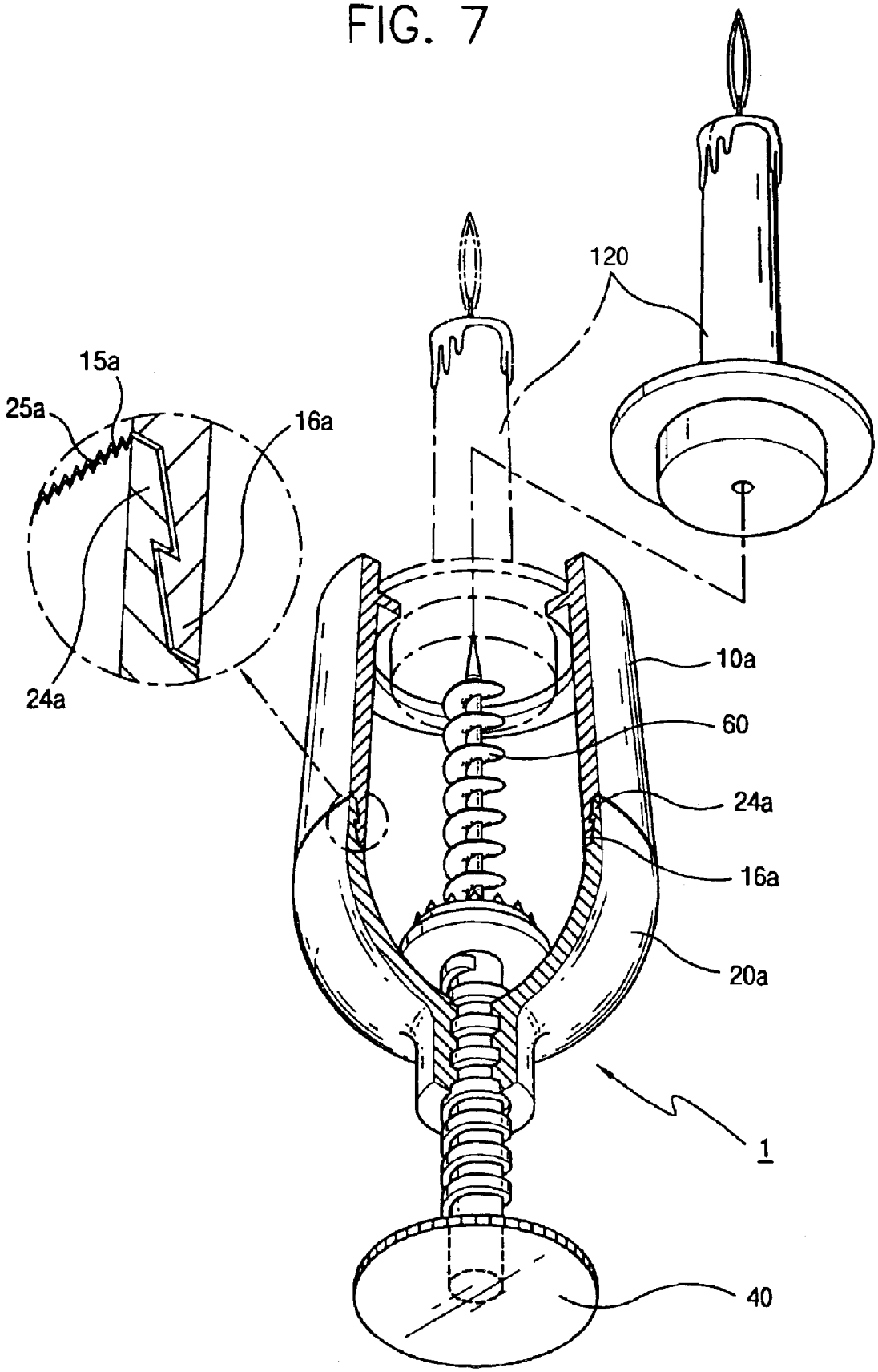
FIG. 7 is a partially cut perspective view of a corkscrew according to a second embodiment of the present invention.

FIG. 7 is a perspective view showing another corkscrew according to the second embodiment of the present invention.

In this embodiment, in order to provide an aesthetic appearance, the push-rotation handle 40 is of a disc form as if it were the bottom of a wine glass stand, and the support body 10*a* and the removal handle 20*a* are coupled to be shaped like a wine glass. A catching portion 16*a* and a coupling support portion 24*a* are formed on one end of the support body 10*a* and on one end of the removal handle 20*a*, respectively, to have the support body 10*a* and the removal handle 20*a* rotatably engaged in the middle portion of the wine glass-shaped corkscrew. Due to the rotatable engagement, the user can make the conveying screw 30 move backwards by rotating the removal handle 20*a* on the support body 10*a*. The exterior surface of the wine glass-shaped corkscrew may have various embossed or engraved patterns to prevent the user's hand(s) from slipping during operation and at the same time to allow the user to hold the corkscrew without any difficulty and to present a good appearance.

In particular, catching protrusions 15*a* and 25*a* are formed on any one pair of horizontally corresponding portions between the catching portion 16*a* of the support body 10*a* and the coupling support portion 24*a* of the removal handle 20*a*. The catching protrusions 15*a* and 25*a* may restrain rotation when the removal handle 20*a* is downwardly pressured on the support body 10*a* (i.e., when the holding screw is inserted into the cork by rotating the push-rotation handle), while they may allow rotation when the removal handle 20*a* is upwardly pressured (i.e., when the holding screw holding the cork is vertically ascended by rotating the removal handle).

The catching protrusions 15*a* and 25*a* formed on the pair of the horizontally corresponding portions between the catching portion 16*a* and the coupling support portion 24*a* have a smaller inclination angle than a spiral inclination angle of a conveying screw spiral portion (a spiral portion of the conveying screw). Also, the catching portion 16*a* and the coupling support portion 24*a* are spaced apart in the same or larger height of the catching protrusions 15*a* and 25*a*. Therefore, the downward movement due to the rotation of the push-rotation handle 40 functions to restrain rotation of the removal handle 20*a* because the catching protrusions 15*a* and 25*a* are engaged with each other but during the upward removal the space between the catching protrusions 15*a*, 25*a* is automatically apart by the rotational ascending angle of the spiral portion, so that rotation of the removal handle 20*a* becomes possible. Those operations can be applied to the embodiment of FIG. 1 by forming catching protrusions on contact surfaces between the grip portion 22 of the removal handle and the catching portion 16.

If turned upside down as shown, the corkscrew 1*a* can be used as a candlestick by putting a candle 120 on the holding screw 60.

According to the foregoing embodiments, it could possibly be that the user feels an uncomfortable feeling with respect to friction, between the cutting blades and the circumferential portion of the wine bottle, occurring when the foil is cut by operating the cutting blades in the upper portion of the wine bottle, or that wine is liable to contamination because of broken bits of the foil fallen in the wine bottle via the bottle mouth which is open after the cork is removed. Hence, the third embodiment of the corkscrew of the present invention illustrated in FIGS. 8 to 11B provides a corkscrew having an improved foil cutter which cuts the foil on the side of the wine bottle.

In this embodiment, the push-rotation handle 40 coupled to the lower portion of the conveying screw 30 is shaped like a disc, whereas the support body 10*b* and the removal handle 20*b* are coupled to be shaped like a wine glass for aesthetic purposes. A catching portion 16*b* and a coupling support portion 24*b*, which is caught by and thereby coupled to the catching portion 16*b*, are formed on the middle portion of the wine glass-shaped corkscrew, which is structured such that the support body 10*b* and the removal handle 20*b* are rotatably coupled to each other so that the removal handle 20*b* can have the same function with the foregoing removal handles 20, 20*a* described above. The push-rotation handle 40 functions as a general crown cap bottle opener by having a metal disc 70 which is a downwardly concave disc fixed on a lower inner portion of the push-rotation handle 40. The circumferential portion of the disc-shaped push-rotation handle 40 has slip-proof concaves-convexes 46 to prevent against slipping and to provide easy grips to the users.

In the corkscrew of the present embodiment, the conveying screw 30 is spirally coupled to female spirals formed on an interior surface of the cylindrical removal handle 20*b*. The push-rotation handle 40 is coupled to one end of the conveying screw 30 and the holding screw 60 to the other end of the conveying screw 30. A cutter-installed casing 80 is so installed in the support body 10*b* as to move upwards and downwards within a predetermined swing range. An upper portion of the cutter-installed casing 80 is vertically slit up to approximately two thirds of the casing 80 as to be divided into four portions. External incline portions 82 are formed on two corresponding exterior portions of the divided portions. The external incline portions 82 are recessed in substantially V form along the length direction of the cutter-installed casing 80. Internal incline portions 17*b* are formed on interior surfaces, corresponding to the external incline portions 82, of the support body 10*b*. The internal incline portions 17*b* are bias protruded in substantially V shape. The foregoing external incline portions 82 are preferably formed on the two facing divided portions among the four divided portions of the support body 10*b*. The internal incline portions 17*b* are preferably formed on portions corresponding thereto. Also, the two remaining corresponding divided portions of the cutter-installed casing 80 have rectangular guide grooves 84. The corresponding portions on interior surfaces of the support body 10*b* have guide protrusions 18*b,* so that the cutter installed casing 80 can be vertically guided on the interior surfaces of the support body 10B.

Figure 11A:
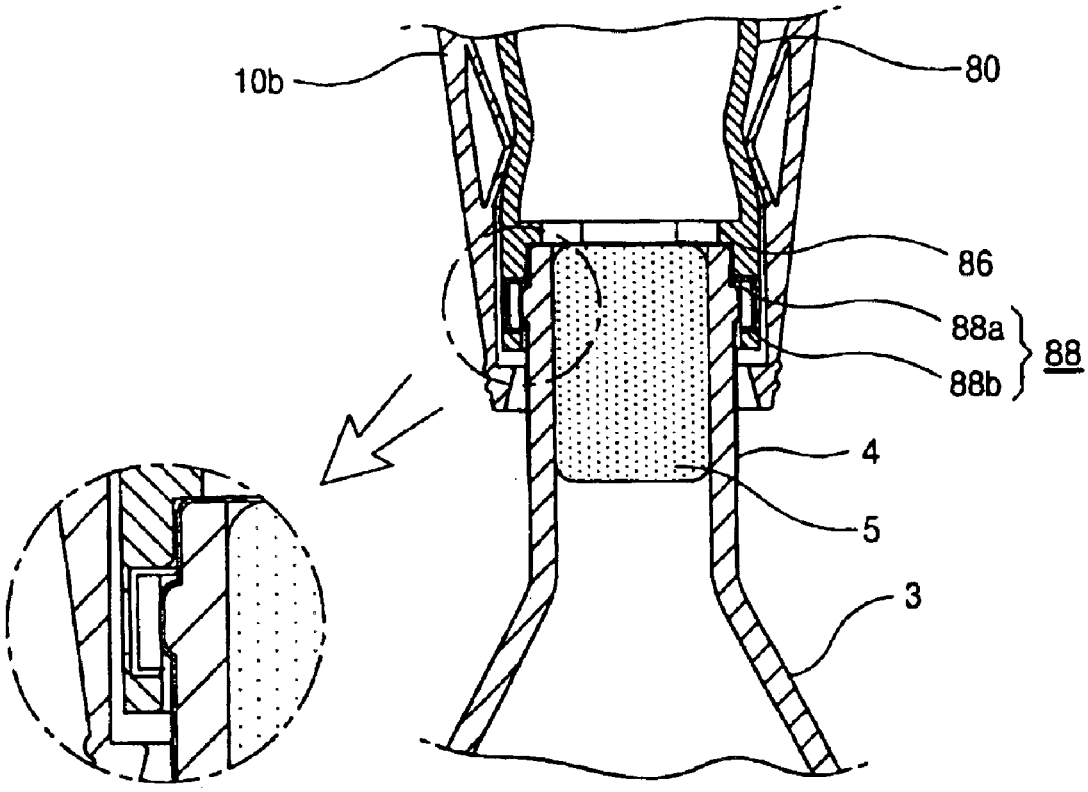
FIGS. 11A and 11B are views showing how to use a double cutter shown in FIG. 8.
Figure 11B:
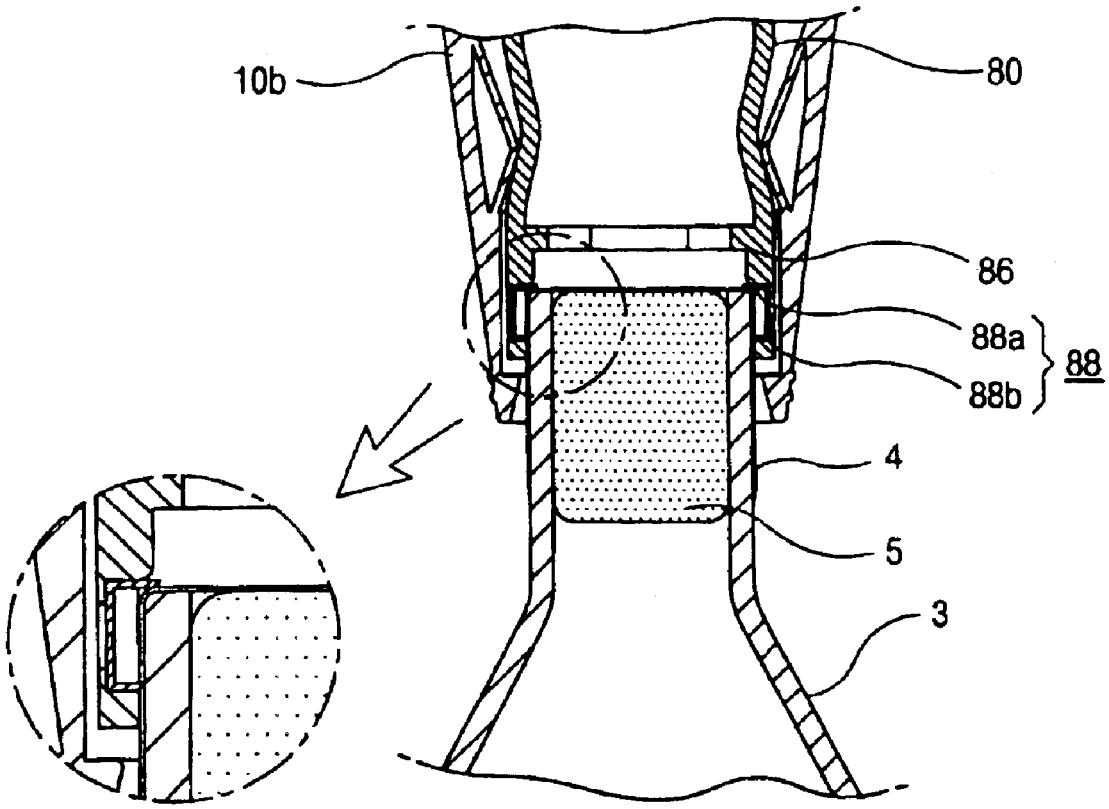

A bottle catching portion 86 is protruded to catch the top of the bottle while the certain portion of the bottle is inserted in the upper interior surface of the cutter-installed casing 80. A double cutter 88 is installed in the cutter-installed casing 80 above the bottle catching portion 86. As shown in FIG. 11A, a lower cutting blade 88*a* of the double cutter 88 cuts the side of a foil 44, which wrapping the mouth of the wine bottle 3, when the wine bottle 3 is seated inside the casing. When the wine bottle 3 is so big that it cannot fully come inside by being caught by the lower cutting blade 88*a,* an upper cutting blade 88*b* cuts the upper side of the foil 4 as shown in FIG. 11B.

Likewise, when the corkscrew is separated from the wine bottle 3 after the cork 5 is removed, the cutter-installed casing 80 is moved upwardly to be restored to the original state. It is possible due to the elasticity of the cutter-installed casing 80 of which the upper and lower portions are divided. For this, it is preferable that the cutter-installed casing 80 is made from synthetic resin such as plastics having good elasticity. Alternatively, for more certain restoration, elastic spring members 90 are installed between the outer bottom of the cutter-installed casing 80 and the inner bottom of the removal handle 20*b* to provide a restoration force in the upward direction.

In particular, the exterior surface of the conveying screw 30 of the corkscrew can be gold-plated for luxurious appearances, and the wine glass-shaped surface formed by coupling the support body 10*b* and the removal handle 20*b* can have various patterns and letters for aesthetic appearances and advertisement effects.

In the corkscrew of the present embodiment, a stopping member 64 is protruded around the boundary between the holding screw 60 and the conveying screw 30. The stopping member 64 restrains the holding screw 60 from penetrating and passing through the cork 5 but still allows the holding screw 60 to be inserted up to a certain depth of the cork 5. As the cork 5 is not fully penetrated and passed through, wine is free from any broken bits of the cork 5 and the wine contamination is therefore avoided.

The present corkscrew can easily remove the cork 5 from the wine bottle 3 by rotating either the wine bottle 3 or the removal handle 20*b* in such that the holding screw 60 is inserted into and holds the cork 5 while the user holds the support body 10*b*.

By turning it upside down, the present corkscrew can be used as a candlestick by putting a candle 120 either directly on the holding screw 60 or on an installation groove of a candle stand plate 122 inserted in and placed over the support body 10*b*.

Figure 8:
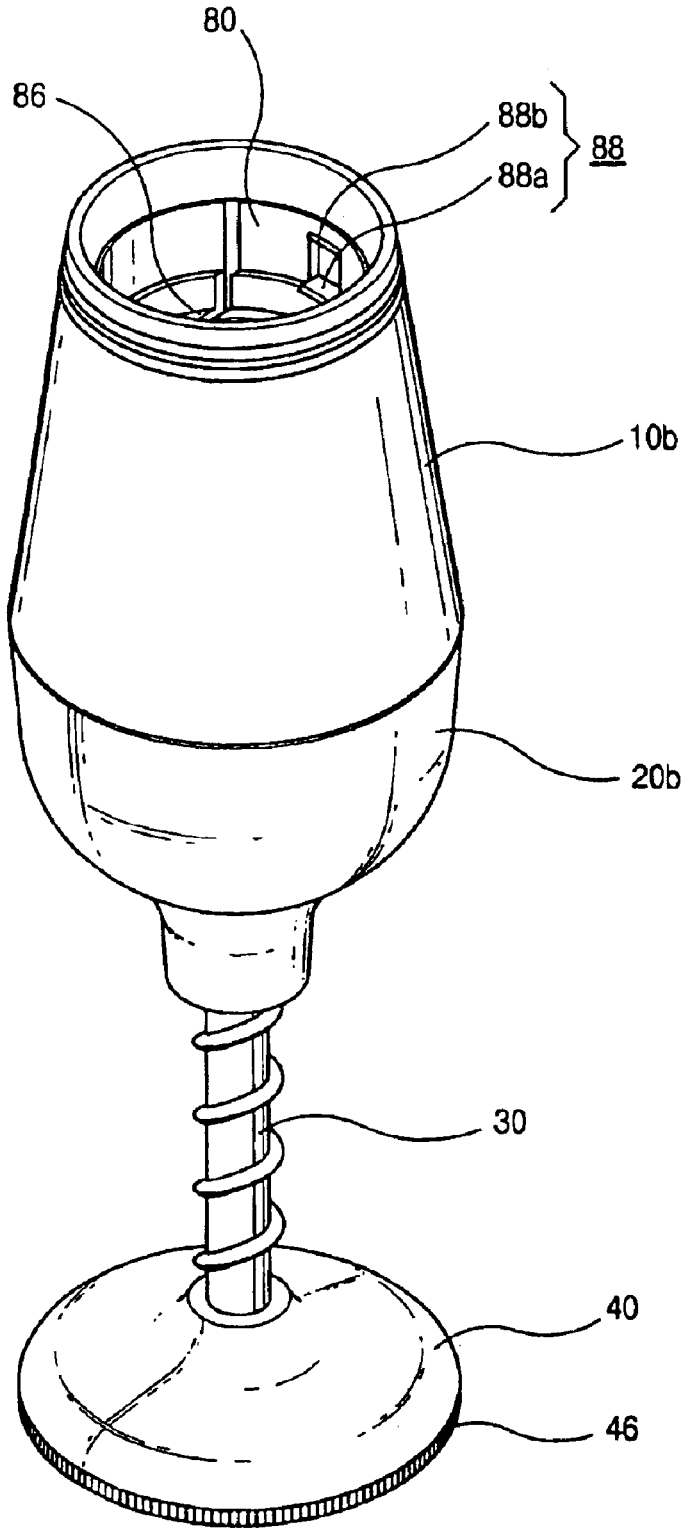
FIG. 8 is a perspective view of a corkscrew according to a third embodiment of the present invention.
Figure 9:
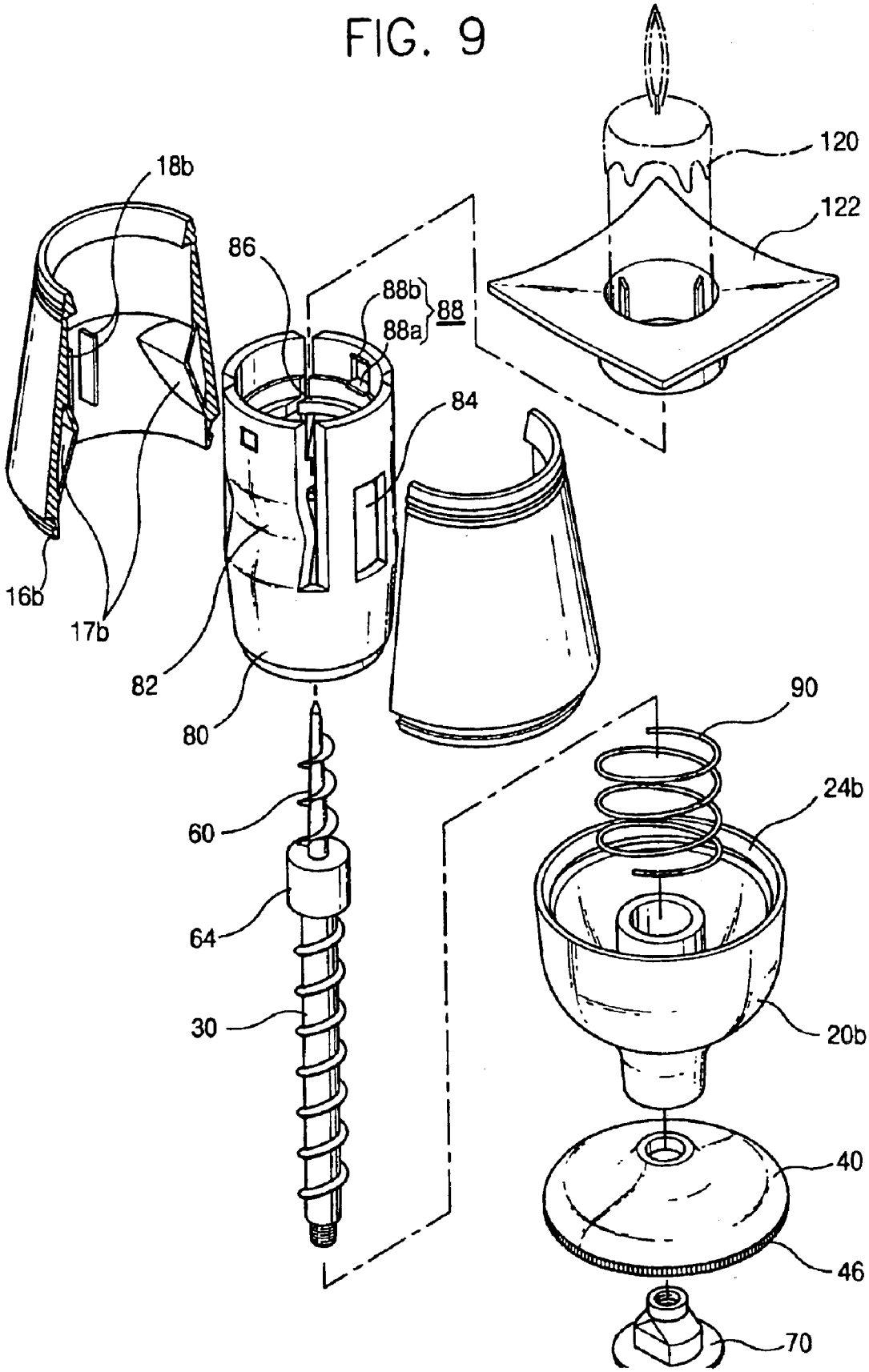
FIG. 9 is a disassembled perspective view of the corkscrew shown in FIG. 8.
Figure 10:
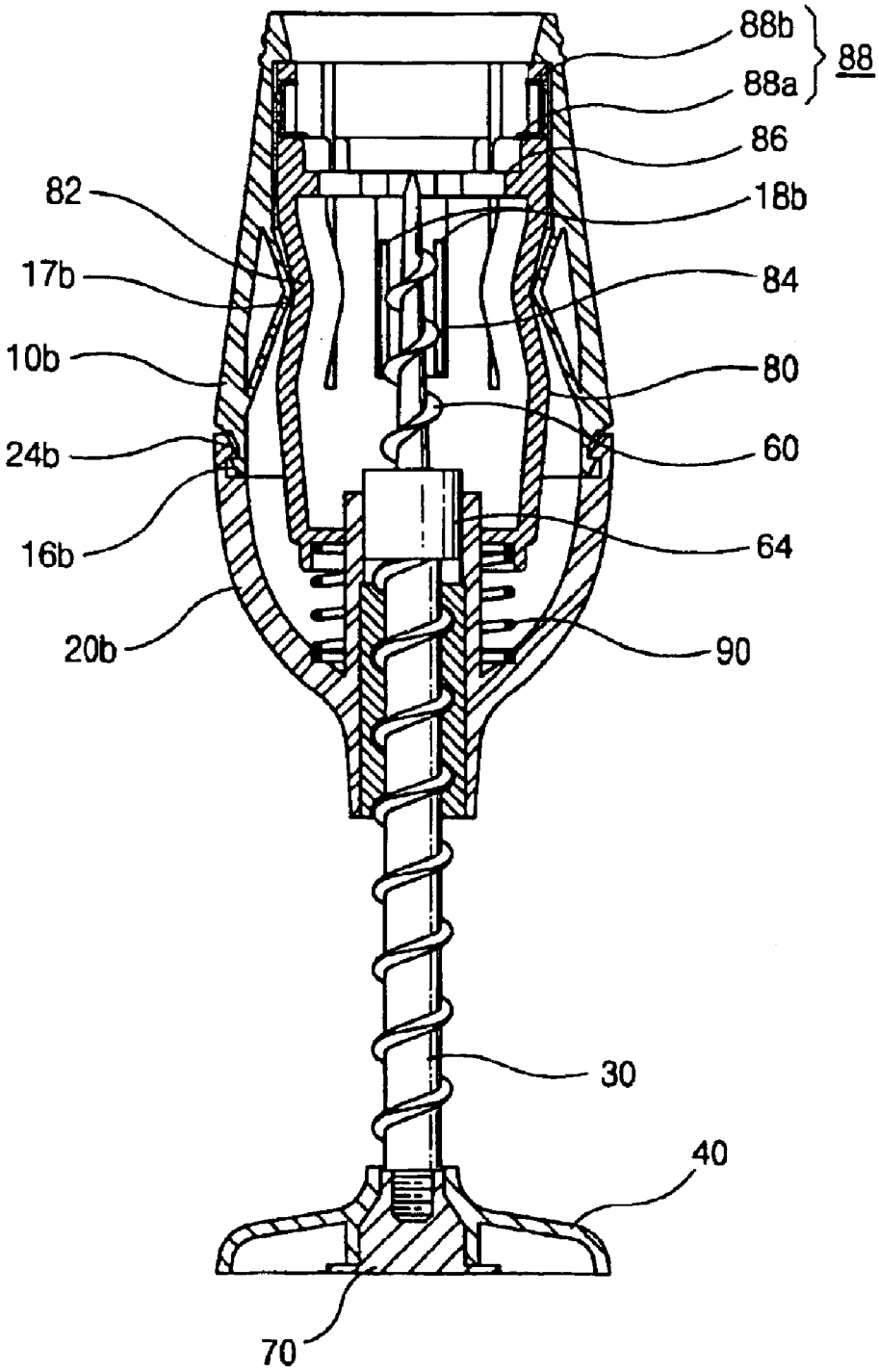
FIG. 10 is a sectional view of the corkscrew shown in FIG. 8.
Figure 12A:
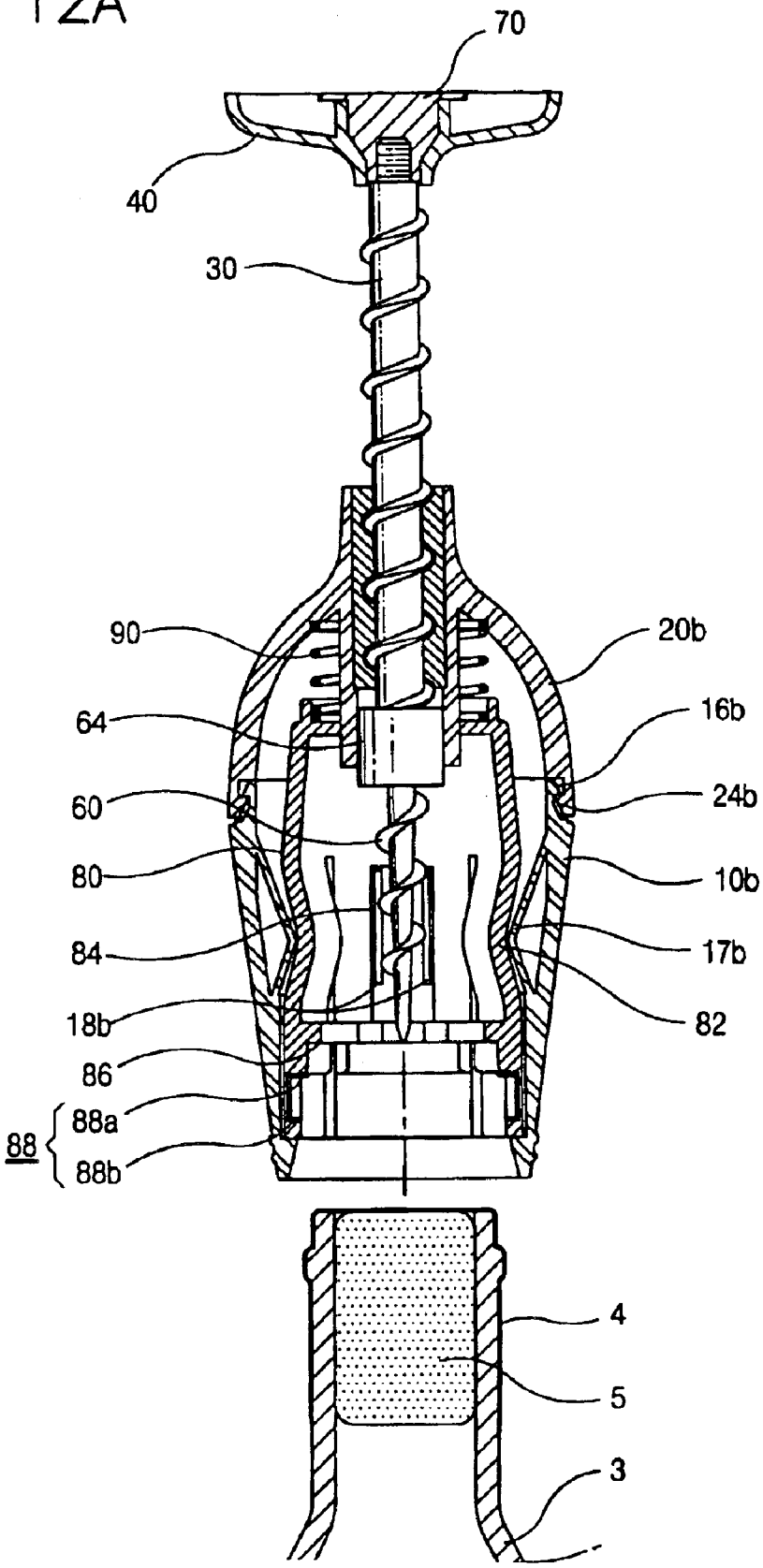
FIGS. 12A and 12B are views explaining operational principles of the corkscrew shown in FIG. 8.
Figure 12B:
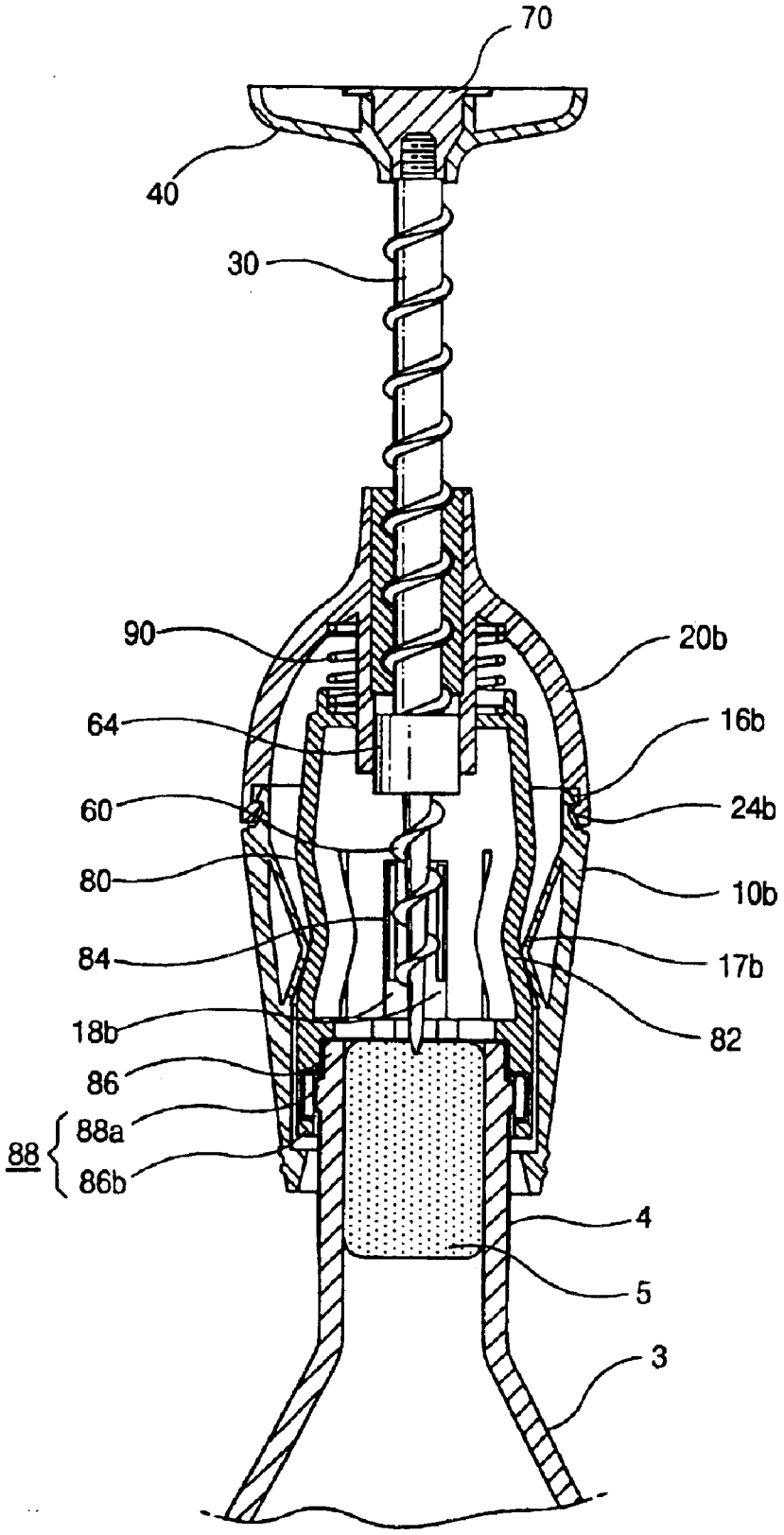

FIGS. 12A and 12B are views for explaining operational principles of the present invention shown in FIG. 8. FIG. 12A shows the state before the bottle is inserted in the cutter-installed casing 80 and FIG. 12B the state after the bottle is inserted therein.

As shown in FIG. 12A, when no force is applied, the corkscrew is upwardly elastically supported by the elastic spring members 90, and the recess portion of the external incline portions 82 is fitted and pressed by the tip head portion of internal incline portions 17*b* by the elasticity of the cutter-installed casing 80. Under this state, when the wine bottle 3 is inserted in the cutter-installed casing 80, the cutter-installed casing 80 is pushed upwardly by the wine bottle 3 as shown in FIG. 12B. And then, the external incline portions 82 of the cutter-installed casing 80 are slid up with respect to tip head portion of the internal incline portions 17*b* of the support body 10*b*, and each of the divided portions of the cutter-installed casing 80 is pushed toward the center thereof. Accordingly, a pair of double cutters 88 installed at the upper internal portion of the divided cutter-installed casing 80 are closely pressed against the side of the foil 4 which wraps the mouth of wine bottle 3. When the push-rotation handle 40 is rotated under this state, the conveying screw 30 is rotated and forwardly moved along the female spiral of the spirally coupled removal handle 20*b*. Accordingly, the holding screw 60 is also rotated and forwardly moved to be inserted into the cork 5. The holding screw 60 can be inserted until the stopping member 64 reaches an upper surface of the cork 5. Since the stopping member 64 restrains the holding screw 60 from entirely penetrating and passing through the cork 5, any broken bits of the corks 5 are prevented from falling into wine.

The corkscrew can remove the cork 5 in two manners. The first manner is that, in the state that the holding screw 60 is fixedly inserted in the cork 5, the user rotates the wine bottle 3 while grabbing the support body 10*b*. The second manner is that the cork 5 is simply separated and removed from the wine bottle 3 by rotating the removal handle 20*b* coupled to the support body 10*b* while the user grabs the support body 10*b*. As the second manner is the same with that of first embodiment and was described in the first embodiment, the first manner is described hereinafter.

When the wine bottle 3 is rotated after the holding screw 60 is inserted and fixed in the cork 5, the double cutter 88 pressed against the foil 4 is rotated and cuts the foil 4 by rotating either the wine bottle 3 or the support body 10*b*. When the wine bottle 3 is continuously rotated, the cork 5, the holding screw 60 inserted in the cork and the conveying screw 30 are rotated together. As a result, the conveying screw 30 is moved upwardly along the female spiral of the coupling hole 108 of the support body 100. Due to the bottle catching portion 104, the wine bottle 3 cannot be ascended but the cork 5 is dragged by the holding screw 60. The user rotates the wine bottle until the cork 5 is fully removed from the wine bottle. Then, the holding screw 60 is continuously upwardly moved and the cork 5 fixed in the holding screw 60 is moved upwardly and thereby removed from the wine bottle 3.

Figure 13:
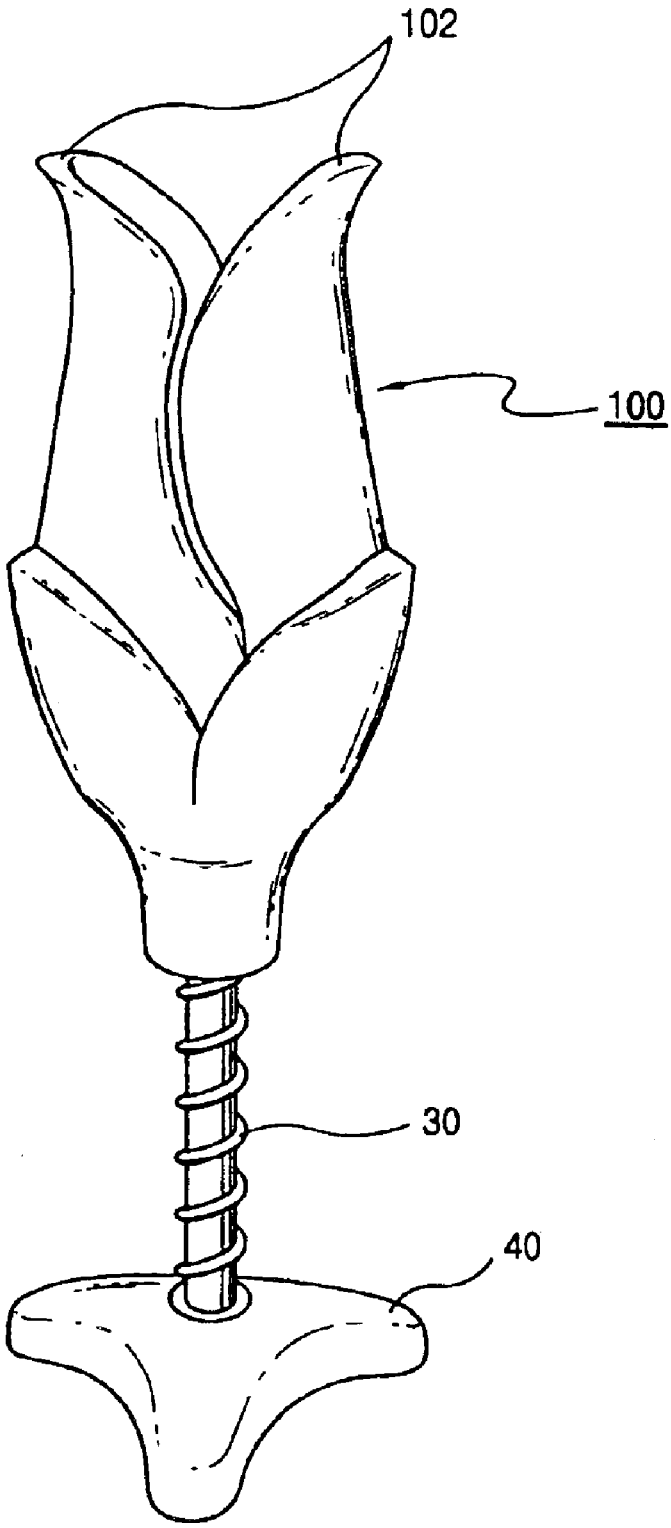
FIG. 13 is a perspective view showing a corkscrew according to a fourth embodiment of the present invention.
Figure 14A:
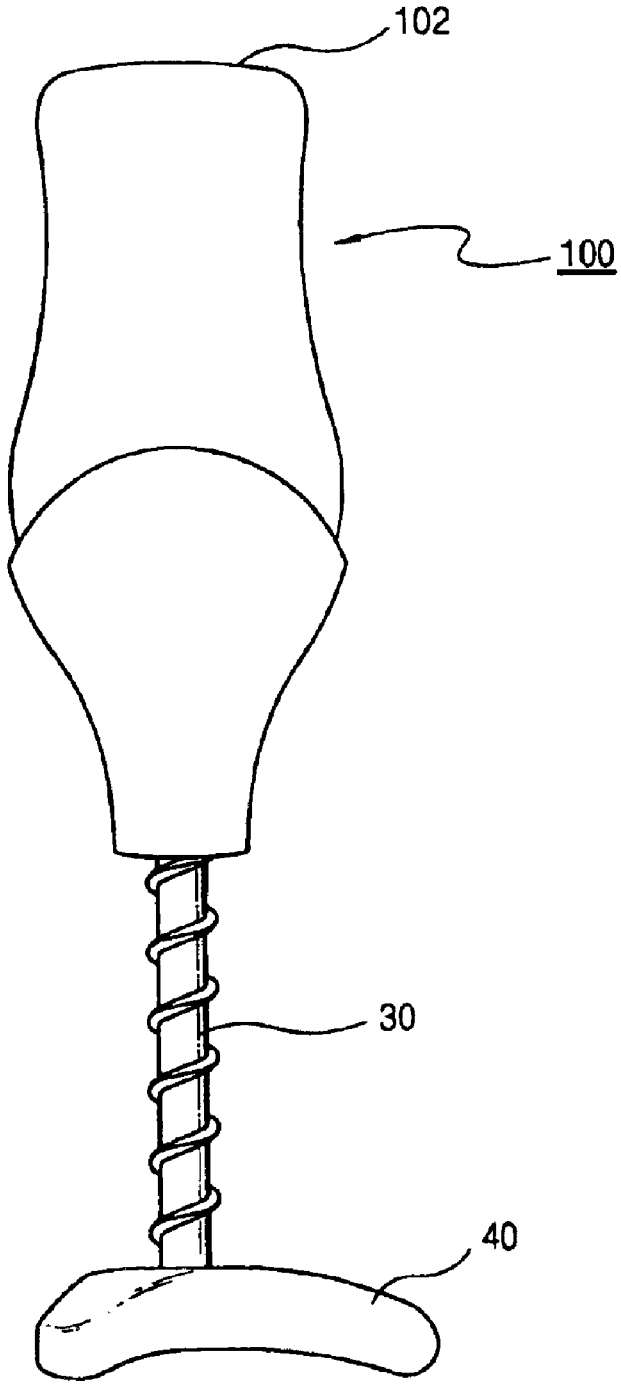
FIGS. 14A and 14B are a side view of, and a plane view of, the corkscrew shown in FIG. 13, respectively.
Figure 14B:
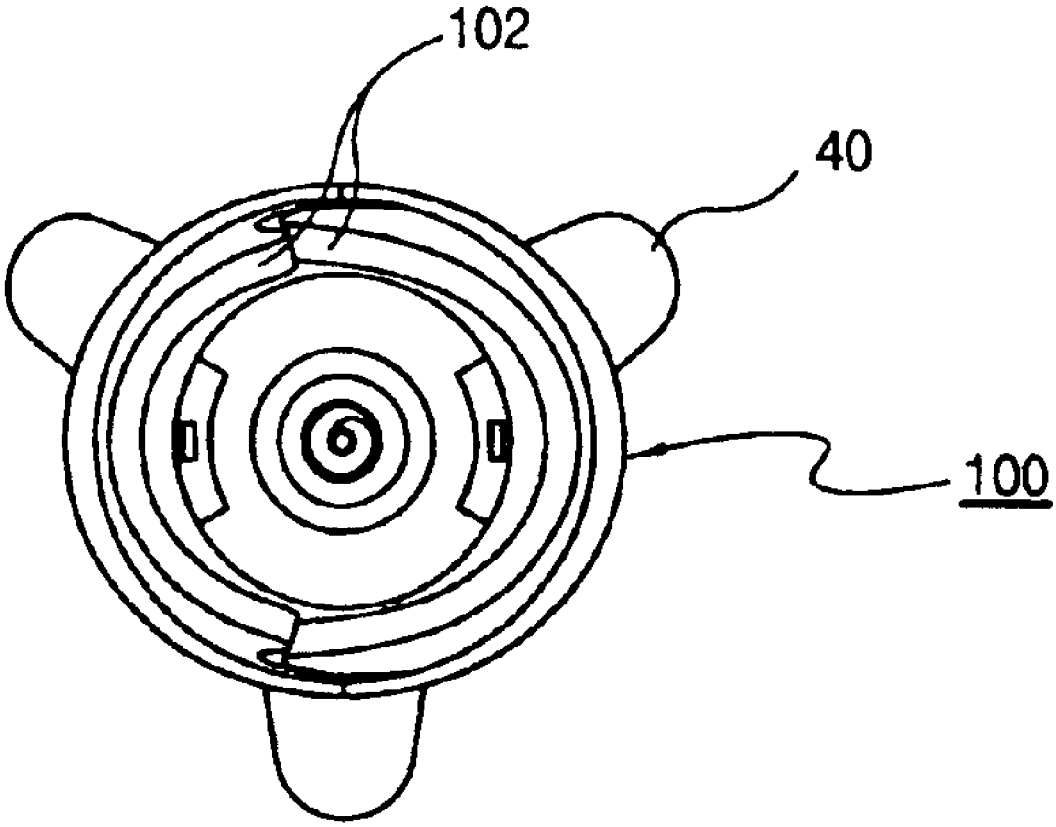
Figure 15:
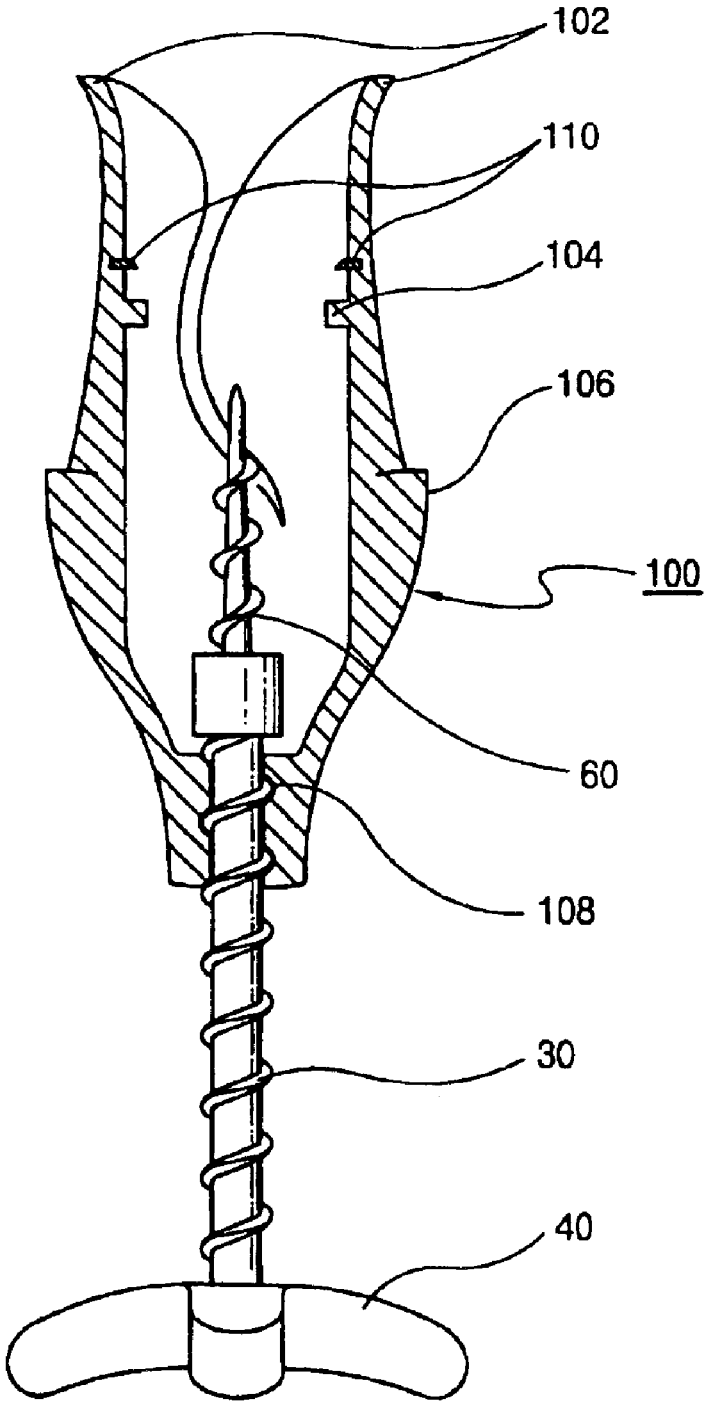
FIG. 15 is a sectional view of the corkscrew shown in FIG. 13.

FIG. 13 is a perspective view illustrating still another embodiment of the present invention. FIGS. 14A and 14B are a side view of, and a plane view of, FIG. 13, respectively. FIG. 15 is a sectional view of FIG. 13.

The embodiments of the present invention illustrated in FIGS. 13 to 15 are developed to simplify the complex structures of the foregoing embodiments, to improve assembly thereof, and to reduce production costs therefor.

Unlike the foregoing embodiments where the support body and the removal handle are coupled to be shaped like a wine glass, the present embodiment is shaped like a bud by removing the removal handle and downwardly extending the support body 100 for simplification. An upper portion of the bud-shaped support body 100 is cut into two sides to be formed in a pair of petals. The support body 100 is made preferably from synthetic resin materials of high elasticity and, more particularly, from plastics of high elasticity. When a bottle is inserted inside the bud-shaped support body 100 of the corkscrew, a pair of upper petals 102 are slightly open with elasticity to receive the support body 100 and the bottle mouth is tightened by the petal's own elasticity to contract. A pair of cutters 110 are installed inside the upper petals 102 having the elasticity so as to cut a foil wrapping the bottle mouth. Preferably, at least two cutters 110 are installed corresponding to a side of the bottle, so that the foil which wraps the side of the bottle is cut. A bottle catching portion 104 is formed near to the cutters 110 to allow the bottle mouth to be inserted into the support body 100 to an appropriate extent. The number of upper petals 102 can be two as shown in this embodiment, or more. The corkscrew can be shaped like a tulip, a rose or other flowers, or even a cylinder. To present a good appearance, the corkscrew of the present embodiment looks like a tulip by having the upper petal 102 and the lower petal 106.

Of course, the support body 100 of the present embodiment has an open coupling hole 108 on which a female spiral is formed. A conveying screw 30 is spirally coupled to the coupling hole 108 with rotation and a holding screw 60 is moved upwardly or downwardly within the support body 100. In particular, a push-rotation handle 40 can be shaped like a triangle as shown in this embodiment, or a circle, or a stick.

Figure 16A:
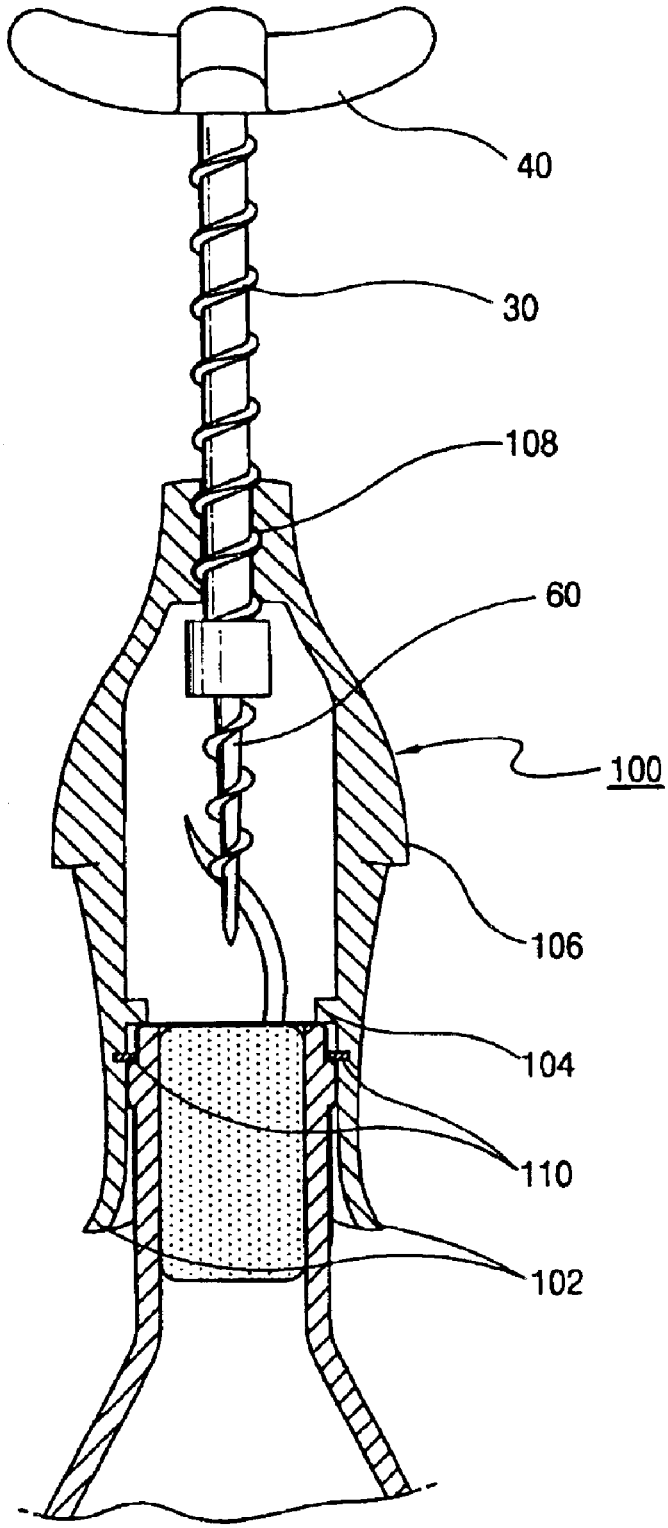
FIGS. 16A and 16B are views explaining operational principles of the corkscrew shown in FIG. 13.
Figure 16B:
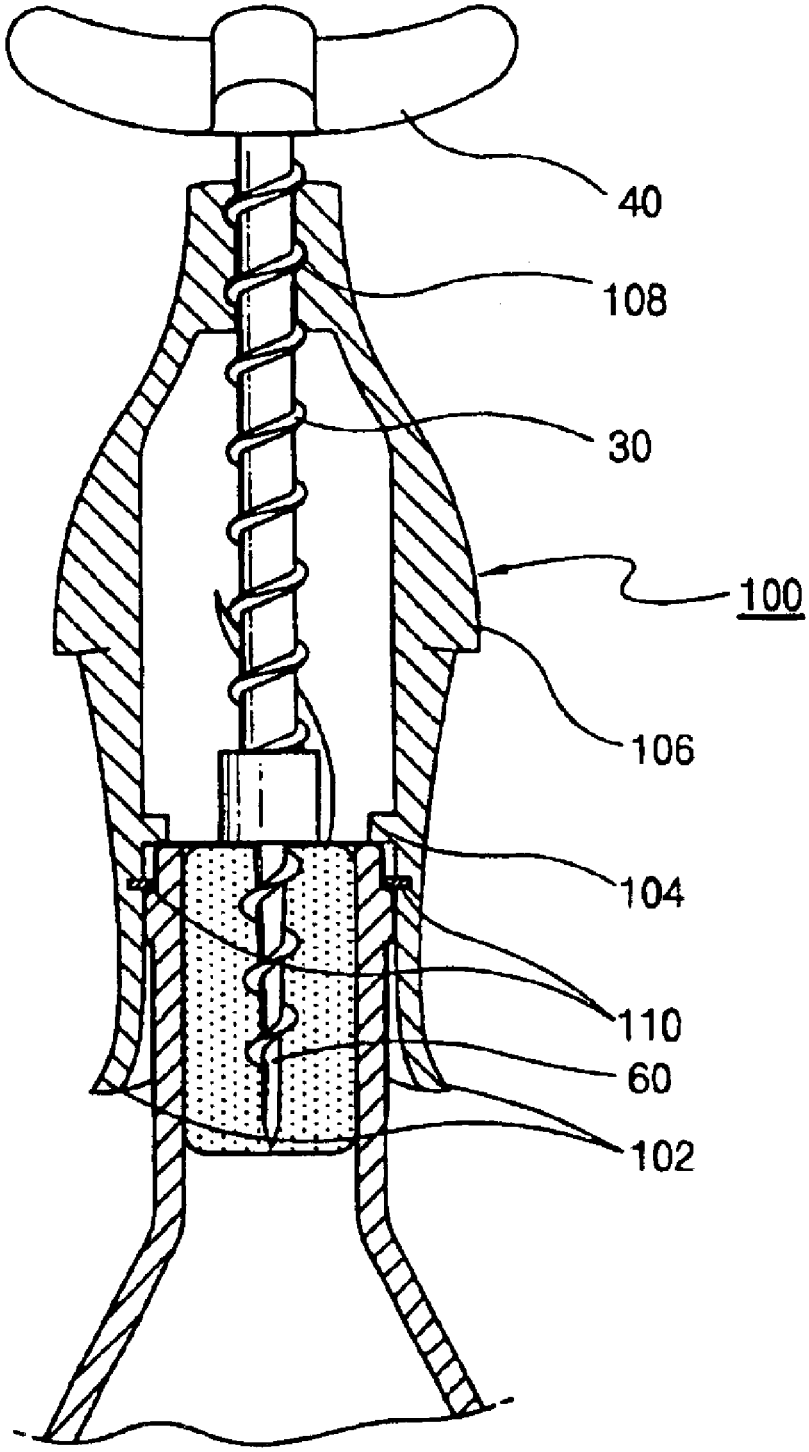
Figure 17:
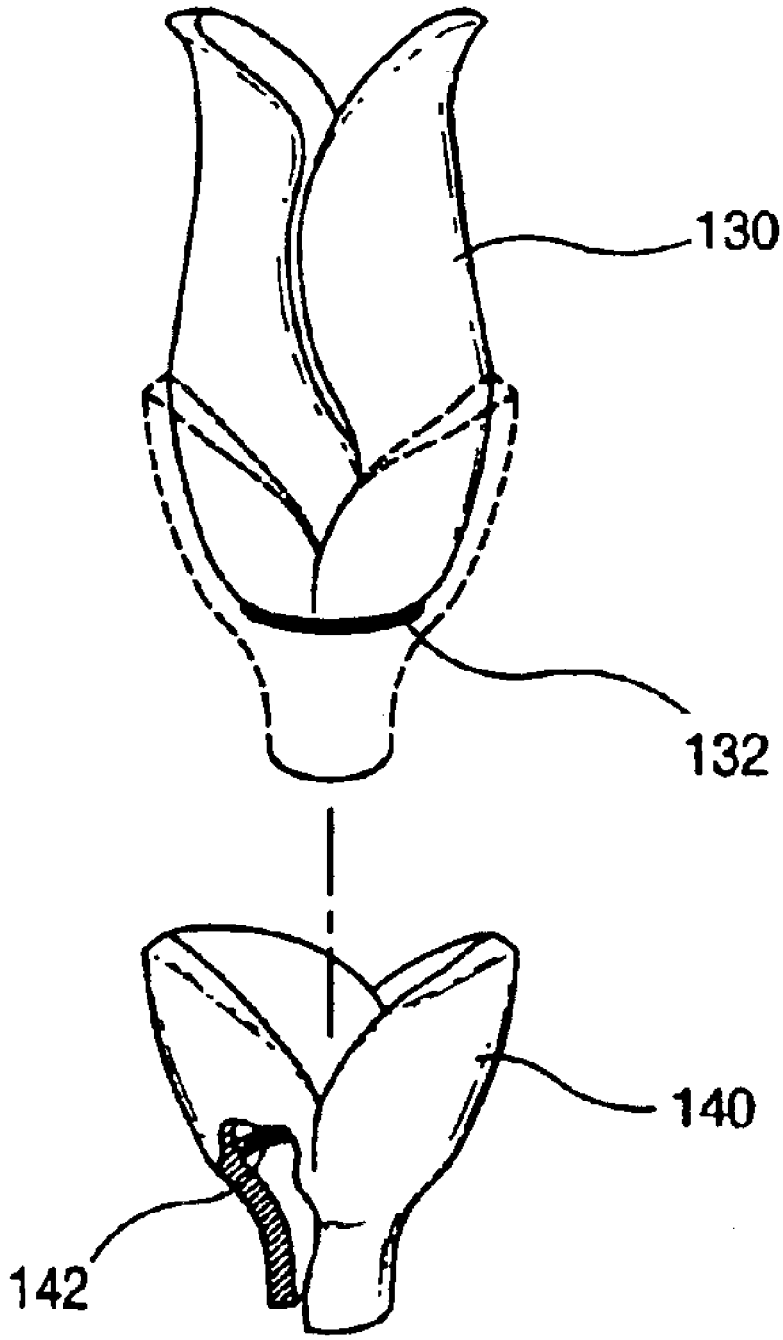
FIG. 17 is a partially abstracted perspective view showing another modification of a support body in bud form illustrated in FIG. 13.

FIGS. 16A and 16B are views for explaining operation principles, illustrated in FIG. 13, of the present invention. FIG. 16A shows the state before a bottle is inserted in the corkscrew and FIG. 16B the state after the bottle is inserted therein. FIG. 17 is a partially abstracted perspective view for showing another modification of a support body in bud form illustrated in FIG. 13.

As shown in FIG. 16A, before the corkscrew is inserted in the bottle 3, the two upper petals 102 in pair are supported upwardly and maintain a certain elasticity by themselves. When the wine bottle 3 is inserted into the support body 100, the pair of upper petals 102 become open outwardly and are inserted until they reach a bottle catching portion 104. Then, the upper petals 102 tighten with elasticity the bottle mouth of the inserted wine bottle 3. A pair of cutters 110 formed on an internal surface of the upper petals 102 are pressed against the foil which covers the side of the wine bottle 3.

When the push-rotation handle 40 is rotated, under the state where the support body 100 of the corkscrew is inserted in the bottle mouth from the outside thereof, the conveying screw 30 is so guided onto the female spiral of the support body 100 as to have the holding screw 60 inserted into the cork 5 of the bottle easily. After the holding screw 60 is fully and fixedly inserted into the cork 5, when the user holds the support body 100 with one hand and rotates the wine bottle 3 with the other hand, the cutters 110 pressed against the foil 4 are rotated to cut the foil 4. Hereinafter, the removal mechanism of the cork 5 is the same as the first method of the second embodiment described above.

FIG. 17 is a partially abstracted perspective view for showing another modification of a support body in bud form illustrated in FIG. 13.

Although the foregoing embodiments of FIGS. 13 to 16B only have the support body without a removal handle to simplify the structure and components, FIG. 17 illustrates the corkscrew having a removal handle 140. In FIG. 17, an upper petal portion acts as a support body 130 and a lower petal covering the upper petal as the removal handle 140. A catching portion 132 is formed on a lower portion of the support body 130, and a coupling support portion 142 is formed on a corresponding portion to the removal handle 140. The removal handle 140 is rotated on the support body 130 by coupling the catching portion 132 and the coupling support portion 142, and the rotation of the removal handle 140 removes the cork from the bottle.

While the present invention has been particularly shown and described with reference to particular embodiments thereof, it will be understood by those skilled in the art that various changes and modifications can be made within the scope of the invention as hereinafter claimed. Therefore, all the changes and modifications of which the meaning or scope is equal to the scope of the claims of the present invention belong to the scope of the claims thereof.

As described above, the corkscrew according to the present invention easily removes a bottle cork from a wine bottle in the manner wherein a cylindrical support body is placed over the bottle mouth of the bottle, a push-rotation handle is rotated until a holding screw connected to the push-rotation handle is inserted into the cork to the depth of a predetermined extent, a removal handle spirally coupled to the push-rotation handle is rotated in the same direction that the push-rotation handle is rotated, and, with the cork being held, the holding screw is moved upwardly thanks to (upward movement of) a conveying screw. In particular, since the cork is removed, while being held by the holding screw, by smoothly rotating the removal handle, the corkscrew according to the present invention is easy and stable to use. Further, the corkscrew is suitable and convenient for women or the aged to use because the cork is easily removed with a little use of force. Also, the wine glass design and various patterns given to the corkscrew described above provide both ergonomic and aesthetic advantages to the users. Particularly, the bud-shaped corkscrew that is pressed, by its own elasticity, against a foil to cut the foil improves productivity and reduces manufacturing costs by simplifying the structure and refining the appearance.

What is claimed is:

1. A corkscrew for removing a cork which covers a bottle mouth of a wine bottle, comprising:

a support body placed over said bottle mouth;

a removal handle, rotatably engaged with said support body, having a coupling hole with a female spiral formed therein;

a conveying screw, coupled to said coupling hole of said removal handle, for forwardly moving with rotation along said female spiral by a rotational force applied to said conveying screw and for moving backwardly, without rotation of said conveying screw, by a rotation of said removal handle;

a holding screw, aligned with and coupled to, as a single body, in a front end of said conveying screw, for penetrating into said cork by the forward rotating movement of said conveying screw and for removing said cork from said wine bottle by the backward movement, without rotation, of said conveying screw; and a push-rotation handle, mounted on an upper portion of said conveying screw, for applying said rotational force to said conveying screw, wherein said coupling hole of said removal handle comprises a cylindrical body having said female spiral formed on an interior of said cylindrical body, to which said conveying screw is spirally coupled; and wherein said removal handle comprises a grip portion extended from an upper exterior portion of said body in the radial direction; and a coupling support portion, extended from a lower exterior portion of said body in a radial direction and retained by a catching portion extended from an upper portion of said support body in the counter radial direction, for rotatable coupling to said support body without a movement in an axial direction.

2. The corkscrew as claimed in claim 1, further comprising a foil cutting means, having at least one cutting blade mounted between said conveying screw and said holding screw, for cutting a foil which wraps said cork of said wine bottle by rotating said at least one cutting blade.

3. The corkscrew as claimed in claim 1, wherein said support body has a stopping member, formed on an internal wall of said support body, for allowing said wine bottle to be inserted into said support body to a predetermined depth, and wherein said stopping member has an inner space of a sufficient height for entirely accommodating said cork being removed from said wine bottle.

4. The corkscrew as claimed in claim 1, wherein said support body and said removal handle are of upper and lower portions of a wine glass shape, respectively, and are rotatably coupled to each other.

5. The corkscrew as claimed in claim 4, wherein said support body and said removal handle are rotatably coupled, respectively, by a catching portion and a coupling support portion which are formed at a center portion of the wine glass shape; said corkscrew further comprises catching protrusions, formed on predetermined corresponding portions of said catching portion and said coupling support portion, for restraining rotation when said removal handle on said support body is pressured toward said support body, and for allowing rotation when said removal handle on said support body is pressured in the opposite direction.

6. A corkscrew for removing a cork which covers a bottle mouth of a wine bottle, comprising:

a casing type support body, placed over said bottle mouth and formed with, at an internal wall of the support body, at least one internal incline portion which is protruded in a direction toward the center of the support body;

a removal handle having a cylindrical body formed with a female spiral at an internal wall and a wing radially extended from an external wall of said cylindrical body, said wing being rotatably engaged with said support body;

a conveying screw, spirally coupled to said cylindrical body of said removal handle, for forwardly moving with rotation along said female spiral by a rotational force applied and for moving backwardly, without rotation of said conveying screw, by a rotation of said removal handle;

a holding screw, aligned with and coupled to, as a single body, in a front end of said conveying screw, for penetrating into said cork by the forward rotational movement of said conveying screw and for removing said cork from said wine bottle by the backward movement, without rotation, of said conveying screw;

a push-rotation handle, mounted on an one end of said conveying screw, for inserting said holding screw into said cork; and a cutter-installed casing, vertically movably mounted in a casing-shaped space defined by said removal handle and said support body, having the structure in which an upper portion of the cutter-installed casing is vertically divided into at least two dividing portions, said cutting-installed casing comprises at least one foil cutter installed on the inside of said dividing portions, wherein a surface of said dividing portions has at least one external incline portion, so that when said bottle mouth of said wine bottle is inserted in a predetermined depth by an external force, said bottle mouth is pushed into said casing-shaped space, said external incline portion is pressed toward the center by said internal incline portion of said support body, and said foil cutter is pressed on a foil surface of a side of said bottle mouth.

7. The corkscrew as claimed in claim 6, wherein said cutter-installed casing is made from an elastic material so that said casing is expanded and restored to an original state by elasticity, while moving upwardly along said internal incline portion when the external force is removed.

8. The corkscrew as claimed in claim 6, further comprising elastic spring members, installed so as to support upwardly said cutter-installed casing, for restoring said cutter-installed casing to the original state during the removal of the external force.

9. The corkscrew as claimed in any of claim 6, wherein said cutter-installed casing has an upper portion which is divided into four dividing portions, said foil cutter is mounted on an internal side of each of a pair of dividing portions which face each other, and said external incline portion is formed on an external side of the dividing portions on which said foil cutter is mounted.

10. The corkscrew as claimed in any of claim 6, wherein said cutter-installed casing has a vertical guiding groove which is formed on a predetermined position of a side of said cutter-installed casing, and a guide protrusion portion, formed on an internal surface of said support body facing said vertical guiding groove, for guiding a vertical movement of said cutter-installed casing when being inserted in said vertical guiding groove.

11. The corkscrew as claimed in claim 6, wherein said support body has a candle stand plate, mounted on an upper portion of said support body, for holding a candle.

12. The corkscrew as claimed in claim 6, wherein said support body has a stopping member, which is internally protruded on an upper portion of said cutter-installed casing, for allowing said wine bottle to be inserted in a predetermined depth, and wherein said foil cutter has double blades which are protruded from a shallower point than said stopping member to the center of said supporting body.

13. A corkscrew for removing a cork which covers a bottle mouth of a wine bottle, comprising:

a support body having an upper portion vertically divided into at least two dividing portions as to be elastically expandable when said bottle mouth of said wine bottle is inserted, at least one cutter mounted on at least one internal wall of said dividing portions for cutting a foil by pressing and rotating said cutter on said foil, and a lower center portion having a coupling hole on which a female spiral is provided;

a conveying screw, spirally coupled to said coupling hole, for forwardly and backwardly moving with rotation along said female spiral when a rotational force applied;

a holding screw, aligned with and coupled to, as a single body, in a front end of said conveying screw, for penetrating into said cork by the forward movement, with rotation, of said conveying screw, and for removing said cork from said wine bottle by the backward movement, with rotation, along said female spiral, of said conveying screw while rotating said wine bottle by a rotational force with the cork being held; and a push-rotation handle, mounted on one end of said conveying screw, for inserting said holding screw into said cork by rotating the push-rotation handle.

14. The corkscrew as claimed in claim 13, wherein said support body has a stopping member, internally protruded on an upper portion of said support body for allowing said wine bottle to be inserted in a predetermined depth, and said foil cutter are protruded from a shallower point than said stopping member to the center of said support body.

* * * * *